US012612754B2

(12) United States Patent
Van Duivendijk et al.

(10) Patent No.: US 12,612,754 B2
(45) Date of Patent: Apr. 28, 2026

(54) PILE INSTALLATION

(71) Applicant: Itrec B.V., Schiedam (NL)

(72) Inventors: Pieter Dirk Melis Van Duivendijk, Schiedam (NL); Eric Romeijn, Schiedam (NL)

(73) Assignee: ITREC B.V., Schiedam (NL)

( * ) Notice: Subject to any disclaimer, the term of this patent is extended or adjusted under 35 U.S.C. 154(b) by 65 days.

(21) Appl. No.: 18/848,040

(22) PCT Filed: Mar. 17, 2023

(86) PCT No.: PCT/EP2023/056963

§ 371 (c)(1),
(2) Date: Sep. 17, 2024

(87) PCT Pub. No.: WO2023/175182

PCT Pub. Date: Sep. 21, 2023

(65) Prior Publication Data

US 2025/0207346 A1 Jun. 26, 2025

(30) Foreign Application Priority Data

Mar. 17, 2022 (NL) ..... 2031316
Sep. 26, 2022 (NL) ..... 2033138

(51) Int. Cl.
*E02D 7/10* (2006.01)
*E02D 7/18* (2006.01)
*E02D 27/52* (2006.01)

(52) U.S. Cl.
CPC ..... *E02D 7/10* (2013.01); *E02D 7/18* (2013.01); *E02D 27/525* (2013.01)

(58) Field of Classification Search
CPC ..... E02D 7/10; E02D 7/18; E02D 27/525; E02D 7/26
See application file for complete search history.

(56) References Cited

U.S. PATENT DOCUMENTS 6,672,805 B1 1/2004 White
7,695,217 B2 * 4/2010 Hessels ..... E02D 7/06 173/90

(Continued)

FOREIGN PATENT DOCUMENTS

BR 8305766 A * 5/1984 ..... E02D 5/62
DE 10 2014 002 986 B3 3/2015

(Continued)

OTHER PUBLICATIONS

International Search Report for PCT/EP2023/056963 (PCT/ISA/210) mailed on May 25, 2023.

(Continued)

*Primary Examiner* — Kyle Armstrong
(74) *Attorney, Agent, or Firm* — Birch, Stewart, Kolasch & Birch, LLP

(57) ABSTRACT

A pile driving method for driving a hollow tubular pile having a vertical centreline, a top end and an open foot end vertically into the soil, e.g. into the seabed, e.g. a large diameter pile having an outer diameter at the open foot end of at least 5 meters, e.g. a monopile of an offshore wind turbine, wherein use is made of a pile driving system, wherein the system includes at least one hammer device and a torsional vibration drive.

27 Claims, 9 Drawing Sheets

(56) References Cited

U.S. PATENT DOCUMENTS

| | | | | |
|---|---|---|---|---|
| 2013/0272797 | A1* | 10/2013 | Bies | B06B 1/183 405/232 |
| 2016/0362864 | A1 | 12/2016 | Thurner et al. | |
| 2022/0290500 | A1* | 9/2022 | Lucon | E21B 3/02 |

FOREIGN PATENT DOCUMENTS

| | | | | |
|---|---|---|---|---|
| EP | 1 781 861 | A1 | 5/2007 | |
| KR | 101726229 | B1 * | 4/2017 | E21B 6/02 |
| WO | WO 2006/010758 | A1 | 2/2006 | |
| WO | WO-2012074381 | A2 * | 6/2012 | E02D 7/22 |
| WO | WO 2015/190919 | A2 | 12/2015 | |
| WO | WO 2015/190919 | A3 | 4/2016 | |
| WO | WO 2020/153838 | A1 | 7/2020 | |
| WO | WO 2020/207903 | A1 | 10/2020 | |
| WO | WO 2021/040523 | A1 | 3/2021 | |

OTHER PUBLICATIONS

Written Opinion of the International Searching Authority for PCT/EP2023/056963 (PCT/ISA/237) mailed on May 25, 2023.

* cited by examiner

PILE INSTALLATION

FIELD OF THE INVENTION

The present invention relates to the field of installing a hollow tubular pile having a vertical centreline, a top end, and an open foot end vertically into the soil, e.g. into the seabed. For example, the pile is a large diameter pile having an outer diameter at the open foot end of at least 5 meters. For example, the pile is a so-called monopile of an offshore wind turbine.

BACKGROUND OF THE INVENTION

Practical embodiments of monopiles nowadays envisaged include monopiles having a diameter between 5 and 12 meters, and lengths between 60 and 120 meters. In embodiments, the wall thickness of the pile is more than 10 centimetres. For example, the pile may have a mass of more than 1000 tonnes, e.g. more than 2000, or even more than 3000 tonnes.

In practical embodiments, the pile is a steel pile, e.g. composed of ring segments that are welded end to end, with each ring segment being composed of arc segments that are welded to one another to form a ring.

The pile may include a tapered or conical section, e.g. between a larger diameter lower pile section and a smaller diameter pile top section. In another embodiment, the pile has a uniform cross-section over its length. Preferably, the pile has a circular horizontal cross-section over its entire length. In an embodiment, the top end of the pile is provided with a connection structure for a wind turbine mast, possibly with the interface of a transition piece, e.g. a flange for a bolt connection and/or a slip-joint connection structure.

The pile may also be part of a set of piles that form part of a the foundation of an offshore wind turbine, e.g. the foundation being embodied as a tripod secured to three piles that have been driven into the seabed.

A first aspect of the invention relates to pile driving system for driving a hollow tubular pile having a vertical centreline, a top end and an open foot end vertically into the soil, e.g. into the seabed, e.g. a large diameter pile having an outer diameter at the open foot end of at least 5 meters, e.g. a monopile of an offshore wind turbine, wherein the pile driving system comprises an hammer device and a torsional vibration drive.

The monopile installation process is the process of driving the monopile, vertically, into the seabed. The pile driving force, i.e. the force that drives the pile in the axial direction into the sea floor, can be generated by vibrating devices, impact hammers, a pile revolver in combination with one or more helical ribs and/or excavating blades mounted on the monopile.

Typically, piles are driven into the seafloor using an impact hammer, for example drop weight pile driver device or an hydraulic impact hammer. However, this type of pile driving process generates a lot of noise which has a negative impact on the environment, in particular on wildlife in the environment. Therefore, costly and elaborate noise mitigation devices, e.g. bubble sheets, are to be deployed during the pile driving process.

An alternative to the impact hammer is the use of vibratory pile driver devices to drive a pile into the sea floor. This technique produces less noise compared to using impact hammers.

From WO2020/207903 it is known to use a vibrating force directed along the longitudinal axis of the monopile, to drive the monopile into the soil. In addition to the vibrational driving force, water can be used to remove soil from below the foundation pile. This prior art installation process requires a complicated device to be provided at the foot end of the monopile. At the end of the installation process, the device has to be excavated such that it can be used for installation of another foundation pile. The excavation of such a complicated device is difficult and time consuming.

For both the use of known impact hammers and vibratory devices, their effectiveness with large diameter piles is expected to be limited. It is expected that these types of pile driving devices can not produce the pile driving force required to efficiently drive the large diameter foundation piles envisaged for the near future into the seabed.

OBJECT OF THE INVENTION

It is an object of the first aspect of the invention to overcome one or more limitations of pile drive systems of the prior art and methods of driving piles, and at the very least to provide an alternative thereto. The first aspect of the invention furthermore aims to provide an improved, more in particular a more efficient monopile installation process.

SUMMARY OF THE INVENTION

According to the first aspect of the invention a pile driving system as defined in claim 1 is proposed.

The system is on the one based on the presence of one or more pile driver devices, e.g. drop weight pile driver devices, engaging on the top end of the pile, e.g. to provide all or the majority of the vertical pile driving energy, and on the presence of a torsional drive comprising one or more vibratory pile driver devices. The one or more vibratory pile driver devices may in practice be used predominantly to reduce skin friction between the pile and the soil, e.g. not contribution to the vertical pile driving energy or only to a lesser degree than the one or more drop weight pile driver devices.

The first aspect of the invention also provides a method according to claim 20.

In the inventive method a combination of systems is used, the method being based on the presence of a hammer device, e.g. comprising one or more drop weight pile driver devices, engaging on the top end of the pile, e.g. to provide all or the majority of the vertical pile driving energy, and being based on the presence of a torsional vibration drive, e.g. comprising one or more vibratory pile driver devices. The torsional vibration drive may in practice be used predominantly to reduce skin friction between the pile and the soil, e.g. not contribution to the vertical pile driving energy or only to a lesser degree than the hammer device.

In an embodiment of a pile driving system according to the first aspect of the invention, for driving a hollow tubular pile having a vertical centreline, a top end, and an open foot end vertically into the soil, e.g. into the seabed, e.g. a large diameter pile having an outer diameter at the open foot end of at least 5 meters, e.g. a monopile of an offshore wind turbine, the pile driving system comprises:

- at least one hammer device configured to transfer energy from the respective hammer device to the top of the pile at a respective frequency along a pile drive axis, wherein the pile drive axis is parallel to, preferably coincides with, the central longitudinal axis of the pile; and
- a torsional vibration drive, wherein the torsional vibration drive comprises at least one vibratory pile driver device, that engages on the pile or on the hammer device, and wherein each vibratory pile driver device of the torsional vibration drive is configured and operated simultaneously with the operation of the at least one hammer device to apply an alternating force at a respective vibration frequency about the pile drive axis.

Herein, a hammer device refers to an impact hammer or a vibratory hammer.

For example, an impact hammer, also referred to as drop weight device, can be embodied as (hydraulically accelerated) drop weight impact hammer devices, as commonly used for (offshore) pile driving of piles.

For example, a vibratory hammer can be embodied as a vibratory pile driver device, as commonly used for (offshore) pile driving of piles, and is configured to apply an alternating vertical force at a respective vibration frequency along a vertical working line that is associated with the pile driver device and that is parallel to, preferably coincides with, the pile drive axis.

In an embodiment, the system furthermore comprises a floating support connects the torsional vibration drive to the hammer device, or connects the torsional vibration drive to the pile, wherein the floating support is configured to allow free movement of the torsional vibration drive along the pile drive axis to prevent the direct transfer of energy from the hammer device to the torsional vibration drive, and to limit, preferably prevent, free movement of the torsional vibration drive about the pile drive axis to enable direct transfer of the torsional forces from the torsional vibration drive to the hammer device or the pile.

The inventive pile driving system aims to reduce skin friction between the pile and the soil, utilising the vibratory drive, to facilitate driving the pile into the sea floor with the hammer device. It is submitted that the floating support enables the vibratory drive to be combined with the impact hammer, since without the floating support the impact forces generated by the impact hammer during the pile driving process may destroy the vibratory device.

With this embodiment of a pile driving system according to the first aspect of the invention, the hammer device is combined, via a floating support, with a vibratory device for vibrating the pile about the centre line thereof, during the pile driving process.

The torsional vibration drive generates an alternating torsional force to create torsional vibration of the pile, i.e. the torsional force rotates the pile back and forth about its central axis.

In this context, vibration is a movement wherein an object, i.e. the pile, is moved in one direction and subsequently is moved, over about the same distance, in the opposite direction.

Due to the torsional vibration of the pile, the pile surface of the pile is in movement relative to the soil of the seafloor, which reduces the friction between the pile and the soil. Thus, vibrating the pile about its longitudinal axis reduces the friction between the pile and the soil. Due to the reduced friction, driving the pile into the seafloor requires less force. Furthermore, the pile driving process may be shortened. This allows for an efficient pile driving concept.

Also, these aspects allow for a reduction in noise generated by the pile driving process, and thus reduce the impact on the environment. The invention may therefore also allow for a reduction in the noise mitigation required to keep the environmental impact of the pile driving process within acceptable limits, which may reduce the costs of the pile driving process further.

The floating support limits the maximum acceleration, and preferably the maximum deceleration, in the vertical direction, of the vibratory drive during the pile driving process.

During the pile driving process, the impact of the impact hammer accelerates the pile. The impact hammer is coupled with the pile to enable the piling force of the hammer to be directly, i.e. with a minimum loss of energy, transferred from the hammer to the pile. With each impact of the impact hammer, the pile accelerated in the vertical direction, and thus is driven into the sea floor.

Due to the floating support, the impact force generated by the hammer is not directly transferred to the vibratory drive. Furthermore, due to the floating support, the maximal acceleration of the pile, in the vertical direction, during the pile driving process is thus substantially larger than the maximal acceleration of the vibratory drive. The impact of the hammering on the vibratory drive is therefore reduced, which allows for the vibratory drive to be used in combination with an impact hammer.

In an embodiment, the pile driving system comprises multiple hammer devices, that are set up to apply a vertical force along a working line that is associated with the respective hammer device, and wherein the vertical forces in combination create a resultant vertical force having a resultant vertical force working line, and the vertical force working line is parallel to, preferably coincides with, the pile drive axis.

In an embodiment the at least one hammer device is a vibratory hammer device, preferably engaging on the top end of the pile, the vibratory hammer device being configured to transfer energy from the respective vibratory hammer device to the top of the pile at a respective frequency along the pile drive axis.

In an embodiment, the at least one hammer device is a drop weight pile driver device engaging on the top end of the pile, the drop weight pile driver device being configured to transfer energy from the respective drop weight to the top of the pile at a respective frequency along the pile drive axis.

In an embodiment, the torsional vibration drive comprises multiple vibratory pile driver devices e.g. arranged in a circular array around the pile drive axis, and wherein each vibratory pile driver device is configured to apply an alternating force, in a plane perpendicular to the pile drive axis, at a vibration frequency to vibrate the pile about the pile drive axis.

In an embodiment, the torsional vibration drive is distinct from the hammer device and is configured to engage the pile, e.g. at a larger diameter lower pile section below a smaller diameter pile top section of the pile.

In an embodiment, the floating support allows for movement of the torsional vibration drive along the vertical working line relative to the hammer device, e.g. the impact hammer device, over a range of at least 20 cm, preferably at least of at least 40 cm, for example 60 cm or more.

In an embodiment, the floating support is configured to dampen impact forces generated by the at least one hammer device while being transferred from the hammer device to the torsional vibration drive, for example is provided with one or more resilient bodies, e.g. one or more springs or cylinders, between the impact hammer or pile and the torsional vibration drive.

In an embodiment, the torsional vibration drive is configured to apply torsional vibration loads with frequencies of at least 50 Hz, preferably at least 65 Hz, for example 80 Hz.

In an embodiment, the at least one hammer device a vibratory hammer device and is configured to apply vibration loads along the pile drive axis with frequencies of at least 14 Hz, preferably at least 17 Hz, for example 20 Hz.

In an embodiment, the impact hammer device is configured to generate an impact force at a pile driving frequency, and wherein the torsional vibration drive generates a torsional force at a torsion frequency, and wherein the torsion frequency is at least three times, preferably at least four times, for example is at least five times, the pile driving frequency.

In an embodiment, the floating support is provided with dampening means, which dampening means reduce motion of the torsional vibration drive along the pile drive axis and relative to the hammer device, wherein the motion is caused by the hammer device.

In an embodiment, the dampening means have a working trajectory, i.e. the trajectory wherein they reduce the relative speed of the torsional vibration drive, of multiple decimetres, for example have a working trajectory of at least 20 cm preferably of more than 30 cm, for example have a working trajectory of at least 40 cm.

In an embodiment, the dampening means comprise one or more hydraulic cylinders coupled with a gas buffer, and wherein the hydraulic cylinders preferably have a working trajectory of 30 cm.

In an embodiment, the pile drive system comprises an anvil, which anvil is configured to be coupled with the top end of the foundation pile to transfer the axial pile driving force from the pile drive to the foundation pile, and preferably wherein the floating support is mounted to the anvil.

In an embodiment, the floating support comprises multiple support arms, that each have a base end and a support end, that connect the annular frame of the torsional vibration drive to the pile. The support arms are pivotable mounted to the top end of the pile at their base end and are pivotable mounted to the frame of the torsional vibration drive at their support end.

In a further embodiment, the support arms extend substantially tangential to a circle having the pile drive axis at its centre, for example like the floating support of the sixth aspect of the invention. The floating support preferably comprises multiple resilient bodies, for example embodied as hydraulic cylinders linked to a gas buffer. The resilient bodies are for example mounted between the pile and the annular frame of the floating support to dampen vertical movement of the torsional vibration drive relative to the hammer device.

In an embodiment, the pile drive system comprises a sleeve for receiving a top end of the pile, wherein the sleeve is configured to be fixed to the pile against rotation about the longitudinal axis of the pile, and preferably wherein the floating support is mounted to the sleeve.

In an embodiment, the floating support is mounted to the top end of the monopile, e.g. comprises a ring that is mounted on the top end of the of the pile.

The first aspect of the invention furthermore provides a vessel, e.g. a jack-up vessel, provided with a pile driving system according to one or more of the preceding claims.

The first aspect of the invention furthermore provides a pile driving method for driving a hollow tubular pile having a vertical centreline, a top end and an open foot end vertically into the soil, e.g. into the seabed, e.g. a large diameter pile having an outer diameter at the open foot end of at least 5 meters, e.g. a monopile of an offshore wind turbine, wherein use is made of a pile driving system, preferably a pile driving system according to one or more of the preceding claims, wherein the method comprises the steps:

setting up the pile with the open foot in the sea floor, while supporting the pile above water in a radial direction using a pile guide mounted on a vessel, e.g. a jack up vessel.

generating an axial pile driving force along a pile drive axis, using the at least one hammer device, wherein the pile drive axis is to be aligned with the vertical centreline of the pile, to drive the pile into the seafloor;

generating a torsional force about the pile drive axis, using the torsional vibration drive, to rotate the pile about the vertical centreline to reduce friction between the pile and the seafloor; and allowing free movement of the torsional vibration drive along the pile drive axis to prevent the direct transfer of impact forces from the impact hammer to the torsional vibration drive, and limiting, preferably preventing, free movement of the torsional vibration drive about the pile drive axis to enable direct transfer of the torsional forces from the torsional vibration drive to the impact hammer or the pile.

In an embodiment, one or two more vibratory pile driver devices of the torsional drive have a horizontal working line that is directed tangential to the outer surface of the tubular pile so as to create the torsional vibrations, and the hammer device comprises a further pile driver device that is mounted on top of the pile and provides the vertical pile driving force.

In an embodiment, in a method according to the first aspect of the invention for driving a hollow tubular pile having a vertical centreline, a top end and an open foot end vertically into the soil, e.g. into the seabed, e.g. a large diameter pile having an outer diameter at the open foot end of at least 5 meters, e.g. a monopile of an offshore wind turbine, use is made of a pile driving system, which pile driving system comprises:

a drop weight pile driver device engaging on the top end of the pile, the drop weight pile driver device being configured to transfer energy from the respective drop weight to the top of the pile at a respective frequency along a vertical working line, which is characterized in that at least one vibratory pile driver device distinct from the drop weight pile driver device engages on the top end of the pile, each vibratory pile driver device being configured and operated simultaneously with the operation of at least one drop weight pile driver device to apply an alternating force at a respective vibration frequency about a working line that is associated with the pile driver device.

So, in the inventive method a combination of systems is used, the one being based on the presence of one or more drop weight pile driver devices engaging on the top end of the pile, e.g. to provide all or the majority of the vertical pile driving energy, and the other one being based on the presence of one or more vibratory pile driver devices that are distinct from the one or more drop weight pile driver devices. The one or more vibratory pile driver devices may in practice be used predominantly to reduce skin friction between the pile and the soil, e.g. not contribution to the vertical pile driving energy or only to a lesser degree than the one or more drop weight pile driver devices.

A second aspect of the invention relates to a pile driving method for driving a hollow tubular pile having a vertical centreline, a top end and an open foot end vertically into the soil, e.g. into the seabed, e.g. a large diameter pile having an outer diameter at the open foot end of at least 5 meters, e.g. a monopile of an offshore wind turbine, wherein use is made of a pile driving system, which pile driving system comprises multiple vibratory pile driver devices.

In the field of driving large diameter piles, for example, use is made of a system as disclosed in WO2015/190919. The FIG. 4 thereof shows a system that is known in the field as the Super Quad Kong. This system has been used in driving monopiles into the seabed for a windfarm in the North Sea. The system has four vibratory pile driver devices mounted on a common rigid bed, that is clamped with multiple clamps onto the top of the monopile. These pile driver devices are each configured to apply an alternating vertical force at a respective vibration frequency along a vertical working line that is associated with the pile driver device.

These alternating vertical forces in combination create a resultant vertical force having a resultant vertical force working line. The working line coincides with the vertical centreline of the monopile.

Another known vibratory pile driving system is the so-called Octa Kong system, wherein eight vibratory pile driver devices are mounted on a common rigid ring structure, that is clamped with multiple clamps to the top end of a very large diameter pile. These pile driver devices are each configured to apply an alternating vertical force at a respective vibration frequency along a vertical working line that is associated with the pile driver device. These alternating vertical forces in combination create a resultant vertical force having a resultant vertical force working line. The working line coincides with the vertical centreline of the pile.

According to the second aspect of the invention a method as defined in clause 1 is proposed.

In the inventive method the multiple vibratory pile driver devices are arranged in a circular array and engage independently from one another on the top end of the pile, each vibratory pile driver device being configured to apply an alternating vertical force at a respective vibration frequency along a working line that is associated with the pile driver device, the alternating vertical forces in combination creating a resultant vertical force having a resultant vertical force working line.

In the inventive method the multiple vibratory pile driver devices are operated to exert their alternating vertical forces out of phase in such a manner that the resultant vertical force is offset from the vertical centreline of the tubular pile and travels about the vertical centreline.

The inventive method aims to reduce skin friction between the pile and the soil. For example, at least four vibratory pile driver devices are included in the circular array, e.g. six, or eight, or another number. In an embodiment, the pile driver devices are each directly connected, e.g. clamped, to the pile, e.g. to the top end thereof. In another embodiment, the pile driver devices are integrated in a common carrier, e.g. allowing all devices to be lifted onto the top end of the pile by a crane.

In the inventive method, these pile driver devices that create the resultant vertical force that is offset from the vertical centreline of the tubular pile and travels about the vertical centreline may be all the devices used for driving the pile into the soil. In another embodiment, one or more additional pile driving devices are employed simultaneously. For example, a single (large capacity) drop weight type pile driver devices is also used. In another example, one or more further vibratory pile driver devices are employed that do have a resultant force that does coincide with the centreline of the pile.

In a practical embodiment, the pile driving system comprises a controller that monitors the phase of each of the multiple vibratory pile driver devices that are operated to exert their alternating vertical forces out of phase, which controller further allows for adjustment of the out of phase operation. As is known in the art, the controller may also allow for adjustment of the vibration frequency, for example.

In a practical embodiment, the motion of the top end of the pile in the horizontal plane is monitored, e.g. to monitor and/or control the operation of the pile driver devices that create the resultant vertical force that is offset from the vertical centreline of the tubular pile and travels about the vertical centreline. For example, such monitoring is done use (laser) distance measuring equipment, and/or inertia based measuring equipment, etc.

The second aspect of the invention also relates to a method according to a pile driving method for driving a hollow tubular pile having a vertical centreline, a top end and an open foot end vertically into the soil, e.g. into the seabed, e.g. a large diameter pile having an outer diameter at the open foot end of at least 5 meters, e.g. a monopile of an offshore wind turbine, wherein use is made of a pile driving system, which pile driving system comprises:

multiple drop weight pile driver devices in a circular array engaging independently from one another on the top end of the pile, each pile driver device being configured to transfer energy from the respective drop weight to the top of the pile at a respective frequency along a working line that is associated with the pile driver device, the energy transfers of the pile driver devices in combination creating a resultant vertical force having a resultant vertical force working line.

An example of such a method is disclosed in EP1781861. Herein, it is disclosed that for optimal pile driving the multiple drop weight pile driver devices are synchronised such that their blows are within 10 milliseconds.

In accordance with the present second aspect of the invention, a method is proposed wherein the multiple drop weight pile driver devices are operated to perform their respective energy transfers out of phase in such a manner that the resultant vertical force is offset from the vertical centreline of the tubular pile and travels about the vertical centreline.

It will be appreciated that it is envisaged that this operation results in a reduced skin friction.

The second aspect of the invention also relates to a pile driving system as discussed herein.

A third aspect of the invention relates to a pile driving method for driving a hollow tubular pile having a vertical centreline, a top end and an open foot end vertically into the soil, e.g. into the seabed, e.g. a large diameter pile having an outer diameter at the open foot end of at least 5 meters, e.g. a monopile of an offshore wind turbine, wherein use is made of a pile driving system, which pile driving system comprises:

a vibratory pile driver devices engaging on the top end of the pile, the vibratory pile driver device being configured to apply an alternating force at a respective vibration frequency along a working line that is associated with the pile driver device.

For example, reference is made to WO2021/040523. Herein it is explained, that in order to reduce skin friction torsional vibrations are introduced into the pile by operation of one or more vibratory pile driver devices. In an embodiment, one or two more vibratory pile driver devices have a horizontal working line that is directed tangential to the outer surface of the tubular pile so as to create the torsional vibrations. A further pile driver device is mounted on top of the pile and provides the vertical pile driving force.

According to the third aspect of the invention a pile driving method is provided for driving a hollow tubular pile having a vertical centreline, a top end and an open foot end vertically into the soil, e.g. into the seabed, e.g. a large diameter pile having an outer diameter at the open foot end of at least 5 meters, e.g. a monopile of an offshore wind turbine, wherein use is made of a pile driving system, which pile driving system comprises:

a vibratory pile driver device engaging on the top end of the pile, the vibratory pile driver device being configured to apply an alternating force at a respective vibration frequency along a working line that is associated with the pile driver device which is characterized in that the vibratory pile driver device is configured and operated to have a horizontal working line so that a lateral vibratory force is exerted on the top end of the pile.

So, instead of torsional vibrations to top end of the pile is effectively made to sway in a vertical plane in order to reduce skin friction.

The third aspect of the invention is based on the insight that, especially for large diameter piles, effectively inducing torsional vibrations may prove impractical. Making the pile controllably sway in a vertical plane appears practical even for large diameter piles, e.g. by using a circular arrangement of such pile driver devices that operate in unison to create the controlled lateral vibration of the top end of the pile.

For example, two vibratory pile driver devices are mounted at diametrically opposed positions on the top end of the pile, the pair or devices being configured and operated to have a horizontal working line, e.g. a common working line, so that a lateral vibratory force is exerted on the top end of the pile. One or more further vibratory pile driver devices may be mounted at other positions on the top end of the pile and have parallel working lines to assist in inducing the lateral vibration.

The third aspect of the invention also relates to a pile driving system as discussed herein.

A fourth aspect of the invention relates to a pile driving method for driving a hollow tubular pile having a vertical centreline, a top end and an open foot end vertically into the soil, e.g. into the seabed, e.g. a large diameter pile having an outer diameter at the open foot end of at least 5 meters, e.g. a monopile of an offshore wind turbine, wherein use is made of a pile driving system, which pile driving system comprises:

a drop weight pile driver device engaging on the top end of the pile, the drop weight pile driver device being configured to transfer energy from the respective drop weight to the top of the pile at a respective frequency along a vertical working line.

For example, a use is made of a system as disclosed in WO2020153838. In this document, systems are described that allow to create enormous pile driving energy for driving of a monopile into the soil. Generally, herein use is made of a very large mass that is dropped (without being accelerated other than via gravity). For example, the energy transfer is devoid of mechanical impact energy transfer.

The fourth aspect of the invention proposed a pile driving method for driving a hollow tubular pile having a vertical centreline, a top end and an open foot end vertically into the soil, e.g. into the seabed, e.g. a large diameter pile having an outer diameter at the open foot end of at least 5 meters, e.g. a monopile of an offshore wind turbine, wherein use is made of a pile driving system, which pile driving system comprises:

a drop weight pile driver device engaging on the top end of the pile, the drop weight pile driver device being configured to transfer energy from the respective drop weight to the top of the pile at a respective frequency along a vertical working line, which is characterized in that at least one vibratory pile driver device distinct from the drop weight pile driver device engages on the top end of the pile, each vibratory pile driver device being configured and operated simultaneously with the operation of at least one drop weight pile driver device to apply an alternating force at a respective vibration frequency along a working line that is associated with the pile driver device.

So, in the inventive method a combination of systems is used, the one being based on the presence of one or more drop weight pile driver devices engaging on the top end of the pile, e.g. to provide all or the majority of the vertical pile driving energy, and the other one being based on the presence of one or more vibratory pile driver devices that are distinct from the one or more drop weight pile driver devices. The one or more vibratory pile driver devices may in practice be used predominantly to reduce skin friction between the pile and the soil, e.g. not contribution to the vertical pile driving energy or only to a lesser degree than the one or more drop weight pile driver devices.

In this fourth aspect of the invention, the one or more vibratory pile driver devices may be providing the above-mentioned lateral vibration of the third aspect of the invention. In another embodiment, these one or more vibratory pile driver devices may be providing torsional vibration. In another embodiment, one or more vibratory pile driver devices may be providing vertical vibrations. The one or more vibratory pile driver devices may also provide combinations of the vibrations as mentioned herein, e.g. both vertical and torsional vibrations, e.g. the vertical vibrations serving to reduce skin friction. For example, the one or more vibratory pile driver devices provide vibrations at a higher frequency than the operation of the drop weight pile driver device engaging on the top end of the pile.

The fourth aspect of the invention also relates to a pile driving system as discussed herein.

A fifth aspect of the invention relates to a pile driving method for driving a hollow tubular pile having a vertical centreline, a top end and an open foot end vertically into the soil, e.g. into the seabed, e.g. a large diameter pile having an outer diameter at the open foot end of at least 5 meters, e.g. a monopile of an offshore wind turbine, wherein use is made of a pile driving system, which pile driving system comprises:

a drop weight pile driver device engaging on the top end of the pile, the drop weight pile driver device being configured to transfer energy from the respective drop weight to the top of the pile at a respective frequency along a vertical working line, an energy transfer assembly configured for transfer of energy from the falling drop weight to the top end of the pile.

For example, such a system is disclosed in WO2020153838. In this document, systems are described that allow to create enormous pile driving energy for driving of a monopile into the soil. Generally, herein use is made of a very large mass that is dropped (without being accelerated other than via gravity). For example, the energy transfer is devoid of mechanical impact energy transfer.

The fifth aspect of the invention proposes a pile driving method for driving a hollow tubular pile having a vertical centreline, a top end and an open foot end vertically into the soil, e.g. into the seabed, e.g. a large diameter pile having an outer diameter at the open foot end of at least 5 meters, e.g. a monopile of an offshore wind turbine, wherein use is made of a pile driving system, which pile driving system comprises:

a drop weight pile driver device engaging on the top end of the pile, the drop weight pile driver device being configured to transfer energy from the respective drop weight to the top of the pile at a respective frequency along a vertical working line, an energy transfer assembly configured for transfer of energy from the falling drop weight to the top end of the pile, which is characterized in that the energy transfer assembly is configured and operated to convert a fraction of the energy from the falling drop weight into a torsional stress wave that is exerted on the top end of the pile.

The fifth aspect of the invention is based on the insight that the torsional stress wave, which might also be considered a sound wave, can be created out of a wave travelling axially, vertically as can be observed when the energy from the falling drop weight travels to the top end of the pile. In fact, a fraction is then converted into the torsional stress wave, the rest continuing as axial, vertical, wave.

In an embodiment, for example, an energy transfer assembly comprises a tubular section through which the energy from the falling drop weight travels to the top end of the pile, with said section having a spiralling increased wall thickness portion that causes the creation of the torsional stress wave. This section is connected to the top end of the pile, so that both the torsional stress wave and the axial, vertical stress wave are transmitted to the top end of the pile.

The fifth aspect of the invention also relates to a pile driving system as discussed herein.

A sixth aspect of the invention relates to pile driving method for driving a hollow tubular pile having a vertical centreline, a top end and an open foot end vertically into the soil, e.g. into the seabed, e.g. a large diameter pile having an outer diameter at the open foot end of at least 5 meters, e.g. a monopile of an offshore wind turbine, wherein use is made of a pile driving system, which pile driving system comprises an impact hammer and a vibratory drive.

The monopile installation process is the process of driving the monopile, vertically, into the seabed. The pile driving force, i.e. the force that drives the pile in the axial direction into the sea floor, can be generated by vibrating devices, impact hammers, a pile revolver in combination with one or more helical ribs and/or excavating blades mounted on the monopile.

Typically, piles are driven into the seafloor using an impact hammer, for example drop weight pile driver device or an hydraulic impact hammer. However, this type of pile driving process generates a lot of noise which has a negative impact on the environment, in particular on wildlife in the environment. Therefore, costly and elaborate noise mitigation devices, e.g. bubble sheets, are to be deployed during the pile driving process.

An alternative to the impact hammer is the use of vibratory pile driver devices to drive a pile into the sea floor. This technique produces less noise compared to using impact hammers.

From WO2020/207903 it is known to use a vibrating force directed along the longitudinal axis of the monopile, to drive the monopile into the soil. In addition to the vibrational driving force, water can be used to remove soil from below the foundation pile. This prior art installation process requires a complicated device to be provided at the foot end of the monopile. At the end of the installation process, the device has to be excavated such that it can be used for installation of another foundation pile. The excavation of such a complicated device is difficult and time consuming.

For both the use of known impact hammers and vibratory devices, their effectiveness with large diameter piles is expected to be limited. It is expected that these types of pile driving devices can not produce the pile driving force required to efficiently drive the large diameter foundation piles envisaged for the near future into the seabed.

It is an object of the sixth aspect of the invention to overcome one or more limitations of pile drive systems of the prior art and methods of driving piles, and at the very least to provide an alternative thereto. The sixth aspect of the invention furthermore aims to provide an improved, more in particular a more efficient monopile installation process.

According to the sixth aspect of the invention a pile driving system as defined in clause 9 is proposed.

The pile driving system according to the sixth aspect is configured to drive a hollow tubular pile e.g. a large diameter pile having an outer diameter at the open foot end of at least 5 meters, e.g. a monopile of an offshore wind turbine, vertically into the soil, e.g. into the seabed, the pile having a vertical centreline, a top end and an open foot end.

In an embodiment, according to the sixth aspect of the invention the pile driving system comprises:

an impact hammer, for generating an axial pile driving force along a pile drive axis, wherein the pile drive axis is to be aligned with the vertical centreline of the pile, to drive the pile into the seafloor;

a vibratory drive, for generating an alternating force about the pile drive axis at a vibration frequency, to vibrate the pile about the vertical centreline and reduce friction between the pile and the seafloor; and a floating support that connects the vibratory drive to the impact hammer, or that is configured to connect the vibratory drive to the pile, wherein the floating support is configured to allow free movement of the vibratory drive along the pile drive axis to prevent the direct transfer of impact forces from the impact hammer to the vibratory drive, and to limit, preferably prevent, free movement of the vibratory drive about the pile drive axis to enable direct transfer of the torsional forces from the torsional drive to the impact hammer or the pile.

The inventive pile driving system aims to reduce skin friction between the pile and the soil, utilising the vibratory drive, to facilitate driving the pile into the sea floor with the impact hammer. It is submitted that the floating support enables the vibratory drive to be combined with the impact hammer, since without the floating support the impact forces generated by the impact hammer during the pile driving process would destroy the vibratory device.

With a pile driving system according to the sixth aspect of the invention, an impact hammer is combined, via a floating support, with a vibratory device for vibrating the pile about the centre line thereof, during the pile driving process.

The vibratory drive generates an alternating torsional force to create torsional vibration of the pile, i.e. the torsional force rotates the pile back and forth about its central axis.

In this context, vibration is a movement wherein an object, i.e. the pile, is moved in one direction and subsequently is moved, over about the same distance, in the opposite direction.

Due to the torsional vibration of the pile, the pile surface of the pile is in movement relative to the soil of the seafloor, which reduces the friction between the pile and the soil. Thus, vibrating the pile about its longitudinal axis reduces the friction between the pile and the soil.

Due to the reduced friction, driving the pile into the seafloor requires less force. Furthermore, the pile driving process may be shortened. This allows for an efficient pile driving concept.

Also, these aspects allow for a reduction in noise generated by the pile driving process, and thus reduce the impact on the environment. The invention may therefore also allow for a reduction in the noise mitigation required to keep the environmental impact of the pile driving process within acceptable limits, which may reduce the costs of the pile driving process further.

With the pile driving system according to the sixth aspect of the invention, the floating support limits the maximum acceleration, and preferably the maximum deceleration, in the vertical direction, of the vibratory drive during the pile driving process.

During the pile driving process, the impact of the impact hammer accelerates the pile. The impact hammer is coupled with the pile to enable the piling force of the hammer to be directly, i.e. with a minimum loss of energy, transferred from the hammer to the pile. With each impact of the impact hammer, the pile accelerated in the vertical direction, and thus is driven into the sea floor Due to the floating support, the impact force generated by the hammer is not directly transferred to the vibratory drive. Furthermore, due to the floating support, the maximal acceleration of the pile, in the vertical direction, during the pile driving process is thus substantially larger than the maximal acceleration of the vibratory drive. The impact of the hammering on the vibratory drive is therefore reduced, which allows for the vibratory drive to be used in combination with an impact hammer.

It is submitted that the floating drive allows for a range of movement of the vibratory drive relative to the hammer, wherein the range of movement preferably is at least multiple decimeters, i.e at least 20 cm, preferably at least 40 cm, for example 60 cm.

In an embodiment, the floating support is configured to dampen the impact forces while being transferred from the impact hammer to the vibratory drive, for example is provided with one or more resilient bodies, e.g. one or more springs or cylinders, between the impact hammer and the vibratory drive.

To further limit the acceleration to which the vibratory drive is subjected to, the floating support preferably is not only configured to prevent the direct transfer of the hammering forces onto the vibratory drive, i.e. to limit the increase in vertical speed due to the impact forces of the impact hammer, but also prevents a high decrease in vertical speed, for example due to the vibratory drive landing on the floating support, i.e. reaching the outer limit of the range of relative motion allowed by the floating support.

In an embodiment, the floating supports is provided with dampening means, which dampening means reduce the relative motion of the vibratory drive when one or both limits of the relative movement allowed by the floating support is or are reached.

It is furthermore submitted that the dampening means preferably have a working trajectory, i.e. the trajectory wherein the reduce the relative speed of the vibratory drive, of multiple decimeters, for example have a working trajectory of at least 20 cm preferably of more than 30 cm, for example have a working trajectory of at least 40 cm.

In an embodiment, the dampening means comprise one or more hydraulic cylinders coupled with a gas buffer, and preferably the hydraulic cylinders have a working trajectory of 30 cm.

In an embodiment, the floating support allows for movement of the vibratory drive relative impact hammer along the pile drive axis over a range of at least 20 cm, preferably at least of at least 40 cm, for example 60 cm or more.

In an embodiment, the torsional drive comprises multiple vibratory pile driver devices arranged in a circular array around the pile drive axis, wherein each vibratory pile driver device is configured to apply an alternating force, in a plane perpendicular to the vertical centre line of the pile, at a vibration frequency to vibrate the pile about the vertical centreline.

In an embodiment, the multiple vibratory pile driver devices are arranged in a circular array. For example, at least three vibratory pile driver devices are included in the circular array, e.g. six, or eight, or another number. In a further embodiment, the multiple vibratory devices are supported independently from one another by floating support, e.g. each vibratory pile driver device being supported by a support arm that is pivotably connected with the impact hammer or with a frame mounted to the impact hammer. In such an embodiment, the individual vibratory pile driver devices can move independently form each other in the vertical direction.

In an alternative embodiment, the pile driver devices are integrated in a common carrier, wherein the common carrier is supported relative to the impact hammer by the floating support.

In a further embodiment, the floating support comprises an annular frame configured to, in a working condition, extend about the pile drive axis, and wherein the vibratory drive, e.g. multiple vibratory pile drivers, are mounted to the annular frame.

In an embodiment, the impact hammer generates an impact force at a pile driving frequency, and the vibratory drive generates a torsional force at a torsion frequency, and wherein the torsion frequency is at least five times, preferably at least ten times, for example is at least twenty times, the pile driving frequency.

In an embodiment, the floating support comprises multiple support arms, each arm having a base end and a support end, wherein the support arms are at their base end provided with a pivot axis and at their support end support the vibratory drive, preferably each support arm supporting a vibratory pile driver at the support end of the support arm.

In an embodiment, the pivot axis of each support arm extend in a plane perpendicular to the pile drive axis.

In an embodiment, the pivot axis of each support arm extend in a plane parallel to the pile drive axis In an embodiment, the pivot axis of each support arm extends in a radial direction relative to the pile drive axis In an embodiment, the pivot axis of each support arm extends perpendicular to a longitudinal axis of the support arm In an alternative embodiment, the floating support comprises multiple flexible support arms, each flexible support arm having a base end and a support end, wherein the flexible support arms at their support end support the vibratory drive, preferably each flexible support arm supporting a vibratory pile driver device at the support end of the flexible support arm.

In an embodiment, when seen in a top view, the support arms are tangent to a circle having the pile drive axis at its centre.

In an embodiment, when seen in a top view, the support arms extend in a radial direction relative to the pile drive axis.

In an embodiment, the floating support comprises multiple linkage systems, each linkage system having a base linkage and a support linkage, wherein the linkage systems with their support linkage support the vibratory drive, preferably each linkage system supporting a vibratory pile driver device with the support linkage, preferably such that the vibratory drive can move in a direction parallel to the pile drive axis.

In an embodiment, the floating support comprises multiple fins and slots, extending parallel to the pile drive axis, such that the vibratory drive can move in a direction parallel to the pile drive axis In an embodiment, the floating support comprises one or more resilient bodies, e.g. springs or cylinders, for resiliently supporting the vibratory drive in a direction parallel to the pile drive axis.

In an embodiment, the impact hammer is a gravity hammer, e.g. is a drop weight hammer.

In an embodiment, the impact hammer is a forced impact hammer, preferably is a hydraulically forced impact hammer.

In an embodiment, the impact hammer is a combination of multiple impact hammers, wherein the impact hammers are each configured to transfer energy to the pile at a frequency, and wherein the impact hammers are configured to be operated sequentially.

In an embodiment, the pile drive comprises an anvil, which anvil is configured to be coupled with the top end of the foundation pile to transfer the axial pile driving force from the pile drive to the foundation pile.

In a further embodiment, the floating support is mounted to the anvil.

In an embodiment, the floating support is mounted to the top end of the monopile, e.g. comprises a ring that is mounted on the top end of the of the pile.

In an embodiment, the monopile is configured to be engaged by the floating support, for example is provided with radially extending teeth for cooperating with driving teeth of a floating support and/or is provided with seats at the top end of the monopile for receiving the floating support.

The invention furthermore provides a vessel, e.g. a jack-up vessel, provided with a pile driving system for performing one or more of the pile driving methods discloses herein.

The sixth aspect of the invention furthermore provides a pile driving method for driving a hollow tubular pile having a vertical centreline, a top end and an open foot end vertically into the soil, e.g. into the seabed, e.g. a large diameter pile having an outer diameter at the open foot end of at least 5 meters, e.g. a monopile of an offshore wind turbine, wherein use is made of a pile driving system, preferably a pile driving system according to one or more of the aspects of the invention, wherein the method comprises the steps:

setting up the pile with the open foot in the sea floor, while supporting the pile above water in a radial direction using a pile guide mounted on a vessel, e.g. a jack up vessel.

generating an axial pile driving force along a pile drive axis, using an impact hammer, wherein the pile drive axis is to be aligned with the vertical centreline of the pile, to drive the pile into the seafloor;

generating a torsional force about the pile drive axis, using a vibratory drive, to rotate the pile about the vertical centreline to reduce friction between the pile and the seafloor; and allowing free movement of the vibratory drive along the pile drive axis to prevent the direct transfer of impact forces from the impact hammer to the vibratory drive, and limiting, preferably preventing, free movement of the vibratory drive about the pile drive axis to enable direct transfer of the torsional forces from the torsional drive to the impact hammer or the pile.

According to a seventh aspect, the invention furthermore provides a foundation pile installation method for facilitating driving a foundation pile into the sea floor. According to the seventh aspect, a collapse zone is provided in the sea floor prior to installation of the foundation pile. The collapse zone facilitates soil to move from below the foundation pile during the foundation pile installation process, and thus facilitates driving the foundation pile into the seafloor. Furthermore, with a method according to the seventh aspect, the soil around the foundation pile remains more or less undisturbed, such that an optimal friction between sea floor and the outside of the foundation pile can be obtained, once the pile has been driven into the sea floor.

The seventh aspect provides a first foundation pile installation method, the installation method comprising preparing the seafloor to facilitate driving the foundation pile, e.g. a foundation pile for supporting a wind turbine, up to an installation depth into the sea floor, wherein the foundation pile has a circumferential wall that forms a vertical foundation pile receiving zone when the foundation pile is installed in the seafloor; the method comprising:

providing a central collapse zone by excavating, e.g. drilling or digging, a vertical cavity in the sea floor, wherein the central collapse zone is dimensioned for the pile receiving zone to be formed parallel to, and around, the collapse zone with a soil transfer zone between the central collapse zone and the receiving zone;

positioning the foundation pile relative to the collapse zone and landing the foundation pile with a bottom end thereof into the seafloor, thereby positioning the foundation pile receiving zone around the central collapse zone and forming the soil transfer zone between the central collapse zone and the receiving zone;

driving the pile into the seafloor, e.g. by hammering or vibrating the foundation pile at a top end thereof, thus forming the receiving zone parallel to the collapse zone and around the soil transfer zone, and by driving the pile into the seafloor, at least partially collapsing the vertical cavity in the central collapse zone by pushing away soil from below the circumferential wall of the foundation pile into the soil transfer zone, and thus pushing soil from the soil transfer zone into the collapse zone, the transfer of soil towards and into the central collapse zone facilitating driving the pile into the seafloor.

In a further embodiment, the method comprises providing a liner along the inside of the vertical cavity of the central collapse zone, preferably while excavating the vertical cavity.

In a further embodiment, the liner is configured to collapse into the central collapse zone by driving the foundation pile into the sea floor, the collapse preferably at least partially being caused by pushing soil away from below the circumferential wall of the foundation pile into the soil transfer zone.

In a further embodiment, the method comprises removing the liner prior to driving the foundation pile into the seafloor, and preferably prior to landing the foundation pile with a bottom end thereof into the seafloor.

In a further embodiment, the method comprises preventing collapse of the collapse zone prior to driving the pile into the seafloor by inserting a support body in the vertical cavity, wherein the support body has an outside support surface that is positioned against a wall of the cavity or against a liner provided along the wall of the cavity, and removing the support body prior to driving the foundation pile into the seafloor, and preferably prior to landing the foundation pile with a bottom end thereof into the seafloor.

In a further embodiment, the method comprises providing a grid of central collapse zones, for each facilitating a driving a foundation pile into the sea floor and to thus create a grid of foundation piles.

The seventh aspect furthermore provides a seafloor preparation process, for preparing the seafloor to facilitate driving a foundation pile, e.g. a foundation pile for supporting a wind turbine, up to an installation depth into the sea floor, wherein the foundation pile has a circumferential wall that forms a vertical foundation pile receiving zone when the foundation pile is installed into the seafloor, the method comprising:

providing an annular collapse zone around a central zone by excavating, e.g. drilling or digging, one or more vertical cavities in the sea floor, wherein the annular collapse zone is dimensioned for the pile receiving zone to be formed parallel to, and around, the collapse zone with a soil transfer zone between the central collapse zone and the receiving zone.

In a further embodiment, the method comprises the seafloor preparation process according to clause 9, the installation method further comprising:

positioning the foundation pile relative to the collapse zone and landing the foundation pile with a bottom end thereof into the seafloor, thereby positioning the foundation pile receiving zone around the annular collapse zone and forming the soil transfer zone between the annular collapse zone and the receiving zone; and driving the pile into the seafloor, e.g. by hammering or vibrating the foundation pile at a top end thereof, thus forming the receiving zone parallel to the collapse zone and around the soil transfer zone, and by driving the pile into the seafloor, at least partially collapsing the one or more vertical cavities in the annular collapse zone by pushing away soil from below the circumferential wall of the foundation pile into the soil transfer zone, and thus pushing soil from the soil transfer zone into the collapse zone, the transfer of soil towards and into the annular collapse zone facilitating driving the pile into the seafloor.

In a further embodiment, the method comprises providing a liner along the inside of each of the one or more vertical cavities of the annular collapse zone, preferably while excavating the one or more vertical cavities.

In a further embodiment, the liner/liners is/are configured to collapse into respectively the one or more vertical cavities of the annular collapse zone by driving the foundation pile into the sea floor, the collapse preferably at least partially being caused by pushing soil away from below the circumferential wall of the foundation pile into the soil transfer zone.

In a further embodiment, the method comprises removing the liner/liners prior to driving the foundation pile into the seafloor, and preferably prior to landing the foundation pile with a bottom end thereof into the seafloor.

In a further embodiment, the method comprises preventing collapse of the one or more cavities of the annular collapse zone prior to driving the pile into the seafloor by inserting a support body into each of the one or more vertical cavities respectively, wherein the support body/bodies has/have an outside support surface that is positioned against a wall of the respective cavity or against a liner provided along the wall of the respective cavity, and removing the support body/bodies prior to driving the foundation pile into the seafloor, and preferably prior to landing the foundation pile with a bottom end thereof into the seafloor.

In a further embodiment, the collapse zone comprises an annular cavity, the annual cavity extending around the central zone, and wherein the annular cavity is provided with an inner, for preventing collapse of the core zone, and wherein the outer liner is configured to collapse due to the foundation pile being driven into the sea floor, or wherein the outer liner is removed from the cavity prior to the foundation pile being driven into the sea floor.

In a further embodiment, the method comprises providing a grid of annular collapse zones, for each facilitating a driving a foundation pile into the sea floor and to thus create a grid of foundation piles.

In a further embodiment, the vertical cavity of the annular collapse zone has a depth similar to, or larger than the installation depth.

In a further embodiment, the method comprises providing the collapse zone comprises excavating at least one annular vertical hole around the central zone.

In a further embodiment, the width of the annular hole is larger than the width of the circular wall of the foundation pile, and wherein, when the collapse zone comprises an inner and/or an outer liner, the width of the annular hole is larger than the combined width of the circular wall of the foundation pile and the width of the inner and/or outer liner respectively.

In a further embodiment, the method comprises providing the collapse zone comprises excavating a series of vertical holes distributed around the central zone.

In a further embodiment, at least one of the one or more holes of the annular collapse zone has a depth similar to, or larger than the installation depth.

In a further embodiment, the one or more vertical cavities are filled with a slurry, for example a slurry of bentonite, to prevent full collapse of the one or more vertical cavities prior to the foundation pile being driven into the sea floor.

In a further embodiment, the liner is a corrugated material, wherein the flutes (?) extend in the longitudinal direction of the liner.

In a further embodiment, the collapse zone is located at least within 90%, preferably within 80%, of the radius of the foundation pile, to facilitate landing of the foundation pile such that there is formed a soil transfer zone between the collapse zone and the foundation pile receiving zone, and wherein the soil transfer zone has a width that is wide enough to prevent the collapse zone from influencing the trajectory of the foundation pile while being landed or driven into the sea floor. In an embodiment, the soil transfer zone has a width that is at least twice the width of the circumferential wall of the foundation pile.

In a further embodiment, the collapse zone comprises a soil receiving space, and wherein the volume of the soil receiving space is larger than the volume comprised by the foundation pile receiving zone when the foundation pile is driven into the seafloor at installation depth.

In a further embodiment, the sea floor preparation method is performed from a vessel, preferably a floating vessel, and wherein excavating the one or more vertical cavities of the annular/central collapse zone comprises controlling and/or supporting an excavating device for excavating the one or more holes.

In a further embodiment, the seafloor preparation method, i.e. creating the collapse zone in the seafloor, is run from a first vessel and the foundation pile installation process, i.e. driving the foundation pile into the seafloor, is run from a second vessel.

In a further embodiment, there is at least twenty four hours between the sea floor preparation process and driving the foundation pile into the sea floor.

In a further embodiment, the foundation pile has a diameter of more than 5 meter, preferably has a diameter of at least 8 meter, for example has a diameter of 10 meter or more.

In a further embodiment, the foundation pile is driven into the seafloor up to an installation depth of at least 20 meters, preferably at least 30 meters, for example 40 meters.

In a further embodiment, the circumferential wall of the foundation pile has a width of at least 5 cm, preferably has a width of at least 8 cm, for example has a width of In a further embodiment, the one or more shafts have a depth that is at least 60% of the pile driving depth.

In a further embodiment, the collapse zone comprises multiple shafts, and wherein the shafts have different depths, for example one or more shafts have a depth of 60% of the pile driving depth, and one or more shafts have a depth of 90% the pile driving depth.

In a further embodiment, the foundation pile receiving zone, the soil transfer zone, the collapse zone, and optionally the central zone, are concentric.

It is submitted that preferably the receiving zone is formed by driving the foundation pile into the sea floor, and the radius of the receiving zone is therefore similar to the radius of the wall of the foundation pile and the depth of the receiving zone is similar to the installation depth.

It is furthermore submitted that preferably the actual border between soil transfer zone and foundation pile receiving zone is determined by placing the foundation pile in the foundation pile receiving zone, the foundation pile receiving zone being located below the circumferential wall of the foundation pile, and the soil transfer zone being located directly inward from the circumferential wall of the foundation pile.

The collapse zone comprises one or more holes, which holes are shaped and/or positioned such that they collapse during the pile driving process. Thus, the collapse zone facilitates soil to move away from below the pile during the pile driving process, and thus facilitates driving the foundation pile in the sea floor.

In an embodiment, the combined volume of the one or more holes in the collapse zone is similar to, preferably is larger than, the volume of the pile receiving zone, i.e. the volume of soil to be replaced by the foundation pile when driven into the seafloor up to the pile installation depth. Thus, the volume of soil to be replaced by the foundation pile can be received in the holes of the collapse zone. It is noted that in an embodiment, some of the soil to be replaced with the wall of the foundation pile will be pushed in a radially outward direction, and will thus not be moved towards the collapse zone.

In an embodiment, the circumferential wall of the foundation pile is shaped to push soil towards the collapse zone. For example, the bottom surface of the circumferential wall can be slanted to push the soil predominantly inwards.

In an embodiment, the collapse zone comprises an annular hole, the annular hole having a cross section similar or identical to the cross section of the circumferential wall of the foundation pile.

Because the seventh aspect of the invention facilitates driving the pile into the sea floor, the pile driving process may comprise pile driving devices, for example for hammering and/or vibrating, that engage the top end of the foundation pile. In such a method, no devices, such as drilling devices, excavating devices, etc, are used at the bottom end of the foundation pile, which allows for a less complicated pile driving process. Thus it is not necessary to remove pile driving devices located at the bottom end of the foundation pile once the foundation pile is installed in the seafloor.

The receiving zone is the part of the sea floor that is to be replaced by the wall of the foundation pile.

The soil transfer zone is provided between the collapse zone and the receiving zone.

Typically, holes created for the collapse zone are narrow holes. The holes have a large depth compared to their width and length. Many types of shapes, i.e. cross sections, are possible, e.g. rectangular shaped holes, or circular shaped holes, annular shaped holes.

The one or more holes are distributed over the collapse zone. In an embodiment, the collapse zone comprises multiple circular holes distributed over an annular area, for example distributed in two rings of holes, wherein the holes are evenly distributed over each circle.

The seventh aspect of the invention facilitates driving a pile into the seafloor and thus enables an efficient pile driving process. Furthermore, since less force is required for driving the pile into the sea floor, less noise is generated during the pile driving process.

According to an eighth aspect, the invention furthermore provides a pile installation device and a method for installation a pile, preferably by using the pile installation device according to the fifth aspect of the invention.

It is submitted that offshore wind turbines are often mounted on foundation piles, also known as monopiles, i.e. hollow tubular piles having a vertical centre line, a top end, and an open foot end. These foundation piles are provided with a transition piece onto which the mast of the wind turbine is mounted. In line with the tendency to increase the capacity of wind turbines, and thus with providing larger wind turbines on higher mast, these foundation piles that are used have increased in size and mass.

Typically, wind turbine foundation piles are driven into the seabed using hammers that are mounted on the top end of the foundation pile. This pile driving process generates much noise, which is harmful for marine live. It would therefore be beneficial if an alternative process could be used for driving the pile into the seabed, in particular for the installation of large size foundation piles.

According to the eighth aspect, the invention aims to provide an alternative for mounting wind turbine foundation piles in the seabed, more in particular for providing an alternative to driving a foundation pile into the seabed using a hammer. The invention furthermore aims to provide a pile installation device configured for efficiently lowering a foundation pile into the seabed.

The invention furthermore aims to provide a pile installation device configured for drilling a hole for receiving a foundation pile.

The pile installation device is configured for supporting a pile and for drilling below the to enable the pile to be lowered into the seabed.

The pile installation device comprises a support frame, a pile guide, a pile liner, a pile drill, The support frame comprises a pile guide for supporting the pile in an upright position, and for guiding the pile while it lowers into the seabed.

The support frame is provided with three or more feet, or for example with a single annular foot, for supporting the pile guide, and thus a foundation pile received in the pile guide, in an upright position on the seabed. The feet can be mounted to legs that extend in a radial direction away from the pile guide.

Preferably, the pile configured for adjusting the position of pile guide relative to the foot or feet, and/or is configured to adjust the individual position of the feet relative to the pile guide, to enable the pile guide to be set in an upright position. Thus, the pile guide can be set in n upright position, for supporting a pile in a vertical position, when the seabed surface is not flat and/or is not horizontal.

In an embodiment, the pile guide comprises multiple pile engagement devices, configured to engage the outside surface of the foundation pile, that can individually be positioned relative to the support frame for adjusting the position of a foundation pile supported in the pile installation device.

Furthermore, moveable pile engagement devices can be configured to traverse changes in diameter of the foundation pile. For example, foundation piles typically comprise a wider foot section and a more narrow head section.

The pile support is furthermore provided with a tubular pile liner and pile drill.

During use, the pile is received inside, and concentric with, the pile liner. The pile liner preferably is provided with spacers on the inside, to position the pile inside the pile liner such that there is a space between an outward facing surface of the pile and an inward facing surface of the pile liner. The space between foundation pile and pile liner can be used for removing drilling material away from the lower end of the pile.

During the drilling process, the pile liner and the pile are both lowered into the seabed, more in particular into an annular pile hole drilled by the pile drill.

The pile drill preferably is annular, i.e. comprise a central opening that is wide enough to receive the pile. Thus, the pile can be moved along the outside of the pile.

The drill bit may comprise multiple drill bits.

In an embodiment, the drill comprises an annular frame, having a central drill axis, which annular frame is provided with multiple drill bits supported at regular intervals along the circumference of the frame. The drill bits are set up with their axis parallel to a central axis of the annular frame. Thus, in use, the drill is set up with the drill axis parallel to, preferably coinciding with, a central axis of a monopile to be lowered into the seabed. The direction of drilling is parallel to the drill axis, in a d downward direction into the seabed.

In an embodiment, the drill is configured for moving the annular drill frame about the central drill axis. thus, the drill bits are moved along at least a part of the circumference of the pile. In an embodiment, the drill is configured for iterative movement, for example back and forth along part of the circumference of the pile.

In an embodiment, the pile drill comprises a drive module for driving the drill bits. The drill module may be provided on top of an annular drill frame that supports the multiple drill bits.

In an embodiment, the pile drill is powered by a fluid, for example a liquid or a gas such as air. In an embodiment, the power source for driving the pile drill is mounted on the pile support. In an alternative embodiment, the power source is mounted on a support vessel. The power source may be connected to the pile drill via one or more wires and/or tubes, for example tubes for transporting a fluid for driving the pile drill, that are guided via the space between pile and pile liner to the pile drill. In an embodiment, the pile liner is provided with one or more pipes for guiding air towards the pile drill, for powering the pile drill In an embodiment, the drill is mounted to the pile liner, such that it moves with the pile liner. In such an embodiment, the pile drive may be removed from the pile hole by lifting the pile liner upwards.

In an embodiment, the pile drill removal wires are connected to the pile drill, which wires extend upwards through the space between the pile liner and the foundation pile, for lifting the pile drill out of the pile hole after the drilling process is completed.

In addition, or as an alternative, the drill may be mounted to the outside of the pile. In an embodiment, the foundation pile is provided with coupling means, for example openings, or mounts, that can be engaged by the drill. For example to provide the drill with grip, and to enable the drill to move in an annular direction relative to the pile during the drilling process.

In an embodiment, the drill is provided with electromagnets to temporarily fix the drill to the pile.

In addition, or as an alternative, to drill bits, the drill may be provided with waterjets for drilling a pile hole.

In an embodiment, the pile is at the lower end, i.e. the end that is lowered into the seabed, provided with jet openings. Via these openings, fluid can be jetted, at the lower end of the pile to create a pile hole.

Preferably, the material loosened by drill bits and/or water jets is transported upwards by a fluid flow in a space between the foundation pile and the pile liner.

According to the eighth aspect, the invention furthermore provides a method for installation of a wind turbine foundation pile, preferably using a pile installation device according to the invention.

First, the pile installation device is set up on the seabed. The feet of the pile installation device are preferably anchored in the seabed, for example are provided with one or more spikes that are driven into the seabed. Furthermore, if needed, the relative position of the feet and the pile guide is adjusted to position the pile guide in an upright position, i.e. a position for supporting a pile guide in an upright, i.e. vertical, position.

Preferably, the pile liner and the pile drill are already received in the pile guide when the pile guide is set up. As an alternative, the pile liner and/or the pile drive are mounted into the pile guide after the latter has been set up on the seabed.

The pile liner is concentrically received in the pile guide, and the pile drill is located at the lower end of the pile liner, at the seabed.

The pile guide is now ready to receive a pile. It is submitted that the pile installation device can be set up by a vessel other than the vessel transporting the piles. For example, multiple pile drives can be set up by a first vessel at different locations. Thus, vessel that are configured for transporting and/or for upending a foundation pile and/or for lifting a foundation pile into the pile installation device can be provided. For example a support vessel can be sued for setting up the pile installation device, a barge can be used for transporting a foundation pile to the pile installation device, and a crane vessel can be used for upending the foundation pile and for lifting the foundation pile into the pile installation device.

After the pile installation device is set up on the seabed, a foundation pile is lifted into the pile guide, and into the pile liner held in the pile guide. The pile installation device mat be provided with one or more s at the top end for guiding the lower end of a pile into the pile guide, and preferably aligning the pile with the pile liner received in the pile guide. If present, pile engagement devices may engage part of the pile that is not received in the pile liner, i.e. engage a part of the pile extending above the pile liner.

Preferably, the pile installation device is configured to support the foundation pile in the upright position. In an alternative embodiment, the foundation pile is also supported by a crane, for example during the first part of the pile installation process. In such an embodiment, the crane vessel supporting the pile may support the pile until enough of the pile is lowered into the seabed to such an extent that the pile installation device is able to support the pile in the upright position.

The pile liner is on the inside provided with spacers that center the foundation pile in the pile liner. By lowering the pile in the pile guide, more in particular by receiving the pile in the pile liner, a space is created between the pile and the pile liner. The pile drill is located at the lower end of this space. The space between pile liner and foundation pile is to be used for transporting drilling material, e.g. cuttings, upwards and away from the pile drill.

Once the foundation pile is received in the pile liner, and the pile is supported in the upright position, the pile drill is used for drilling an annular pile hole at the lower end of the foundation pile and the pile liner. The pile drill gradually drills a vertical annular space for receiving the foundation pile and the pile liner. Both the pile and the pile liner follow the pile drill, thus, the annular space between the foundation pile and pile liner follows the pile drill. Thus the drilling material can continuously be transported upwards and away from the pile drill via the annular space.

In an embodiment, the drilling material is removed at the top end of the annular space via one or more outlets, and is for example transported onto a support vessel. On the support vessel, the drilling material may be cleaned, i.e. drilling fluid may be removed, after which the drilling material may be used for filling the space between foundation pile and seabed once the pile liner and pile drill are removed.

When the drilling process is completed, the pile liner and the pile drill are lifted upwards out of the pile hole. Thus, the pile remains in the seabed.

In an embodiment, the space created by removing the pile drill and the pile liner can be filled, for example be cemented. For example, the while the pile drill and the pile liner are lifted out of the pile hole, the space beneath them can be injected with cement and/or material removed during the drilling process. Filing this space may further enhance contact between the seabed and the foundation pile, and thus may improve the stability of the pile.

According to the eighth aspect the invention provides a foundation pile installation device, the foundation pile installation device comprising:

a support frame, configured to be set up on the seabed, the support frame preferably comprising three or more adjustable feet for adjusting the position of the support frame on the sea bed;

a pile liner for receiving a pile, and for moving with the pile while the pile is lowered into the seabed, wherein the pile liner preferably is configured to form a space between the liner and a foundation pile received in the liner;

a pile drill, preferably an annular pile drill, provided at the lower end of the pile liner for drilling a pile hole that can receive the liner and the foundation pile received in the liner; and a pile guide, held in the support frame, for guiding a pile and/or the pile liner wherein a foundation pile is received, during a pile installation process, i.e. while the pile and the pile liner are lowered into the seabed.

In an embodiment, the pile guide comprises an upper section provided with one or more pile engagement devices, for engaging and guiding a foundation pile received in the pile installation device, and a lower section configured for guiding the pile liner, and thus a foundation pile received in the pile liner, while the pile liner is lowered with the foundation pile into the seabed during the installation process.

In an embodiment, the pile drill is fixed to the pile liner, such that, after the drilling process, the pile liner and the pile drill can be removed as a single piece.

In an embodiment, the pile liner is provided with one or more pipes for guiding power fluid to the pile drill. In yet a further embodiment, the pile liner is provided with one or more pipes for guiding cement below the pile drill, to enable cementing of the space created when removing the pile liner and pile drill form the pile hole after the drilling process. Thus, the Pile hole can be cemented while removing the liner and drill, which reduces the chance of the space collapsing prior to being cemented.

It will be appreciated that the first, second, third, fourth, fifth, sixth, seventh and/or eighth aspect can be combined in various combinations, e.g. to optimize the pile driving method and/or pile driving system. For example, the floating support of the sixth aspect of the invention can be used in a pile drive system according to the first aspect of the invention, and the torsional vibration drive according to the first aspect of the invention can be embodied as a vibratory drive according to the sixth aspect of the invention. also, components discussed in context of the vibratory drive according to the sixth aspect of the invention, for example the multiple support arms connecting the vibratory drive to the anvil of the hammer, may be incorporated in a torsional vibration drive according to the first aspect of the invention, for example to connect the floating support to the top end of the pile. Also, for example the features discussed in relation to the sixth aspect may be combined with the first aspect of the invention and vice versa. Also, for example, the floating support that connects the vibratory drive to the impact hammer, according to the sixth aspect of the invention, can for example be used in a pile driving method according to the fourth aspect of the invention, wherein it is combined with the drop weight pile driver device engaging on the top end of the pile and the at least one vibratory pile driver device of the fourth aspect of the invention to provide a pile driving system. Also, for example a method according to the fourth aspect of the invention can be incorporated into a method according to the seventh aspect, that is, a pile driving method according to the fourth aspect of the invention can be used for driving a pile into the sea floor, wherein the seafloor is provided with a collapse zone according to the seventh aspect of the invention.

BRIEF DESCRIPTION OF DRAWINGS

The various aspects will now be described with reference to the drawings. In the drawings.

DETAILED DESCRIPTION OF EMBODIMENTS

Figure 1:
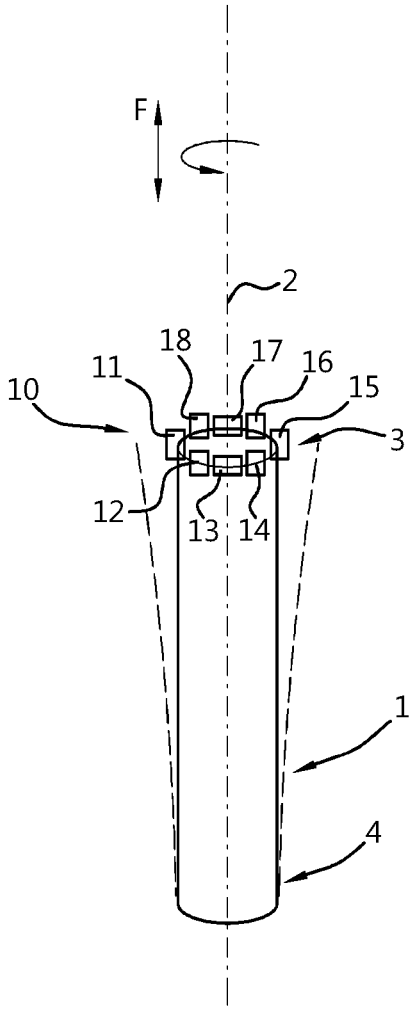
FIG. 1 schematically illustrates the second aspect of the invention.

In FIG. 1 the reference numeral 1 denotes a hollow tubular pile 1 having a vertical centreline 2, a top end 3, and an open foot end 4. The pile 1 is to be driven vertically into the soil, e.g. into the seabed. For example, the pile is a large diameter pile having an outer diameter at the open foot end of at least 5 meters, e.g. of 7 metres or more. For example, the pile is a so-called monopile of an offshore wind turbine.

Practical embodiments of monopiles nowadays envisaged include monopiles 1 having a diameter between 5 and 12 meters, and lengths between 60 and 120 meters. In embodiments, the wall thickness of the pile 1 is more than 10 centimetres. For example, the pile 1 may have a mass of more than 1000 tonnes, e.g. more than 2000, or even more than 3000 tonnes.

In practical embodiments, the pile 1 is a steel pile, e.g. composed of ring segments that are welded end to end, with each ring segment being composed of arc segments that are welded to one another to form a ring.

The pile 1 may include a tapered or conical section, e.g. between a larger diameter lower pile section and a smaller diameter pile top section.

In the second aspect of the invention use is made of a pile driving system 10, which pile driving system comprises multiple vibratory pile driver devices 11, 12, 13, 14, 15, 16, 17, 18. So, in this example eight vibratory pile driver devices, but other numbers, e.g. four, six, ten, etc., can also be used.

The multiple vibratory pile driver devices 11-18 are arranged in a circular array and engage independently from one another on the top end 3 of the pile 1.

Each vibratory pile driver device 11-18 is configured to apply an alternating vertical force at a respective vibration frequency along a working line that is associated with the pile driver device. For example, each device comprises one or more sets of rotating eccentric weights that rotate about associated shafts. For example, hydraulic motors driven the eccentric weights.

The alternating vertical forces create in combination a resultant vertical force having a resultant vertical force working line. In the prior art approach, this resultant vertical force working line coincides with the centreline 2.

In the inventive method of the second aspect of the invention the multiple vibratory pile driver devices 11-18 are operated to exert their alternating vertical forces out of phase in such a manner that the resultant vertical force F is offset from the vertical centreline 2 of the tubular pile and travels about the vertical centreline. This is illustrated in FIG. 1. This approach aims to effectively reduce skin friction between the pile 2 and the soil.

For example, the pile driver devices 11-18 are each directly connected, e.g. clamped, to the pile 1, e.g. to the top end thereof. In another embodiment, the pile driver devices 11-18 are integrated in a common carrier, e.g. allowing all devices to be lifted onto the top end of the pile by a crane.

Figure 2:
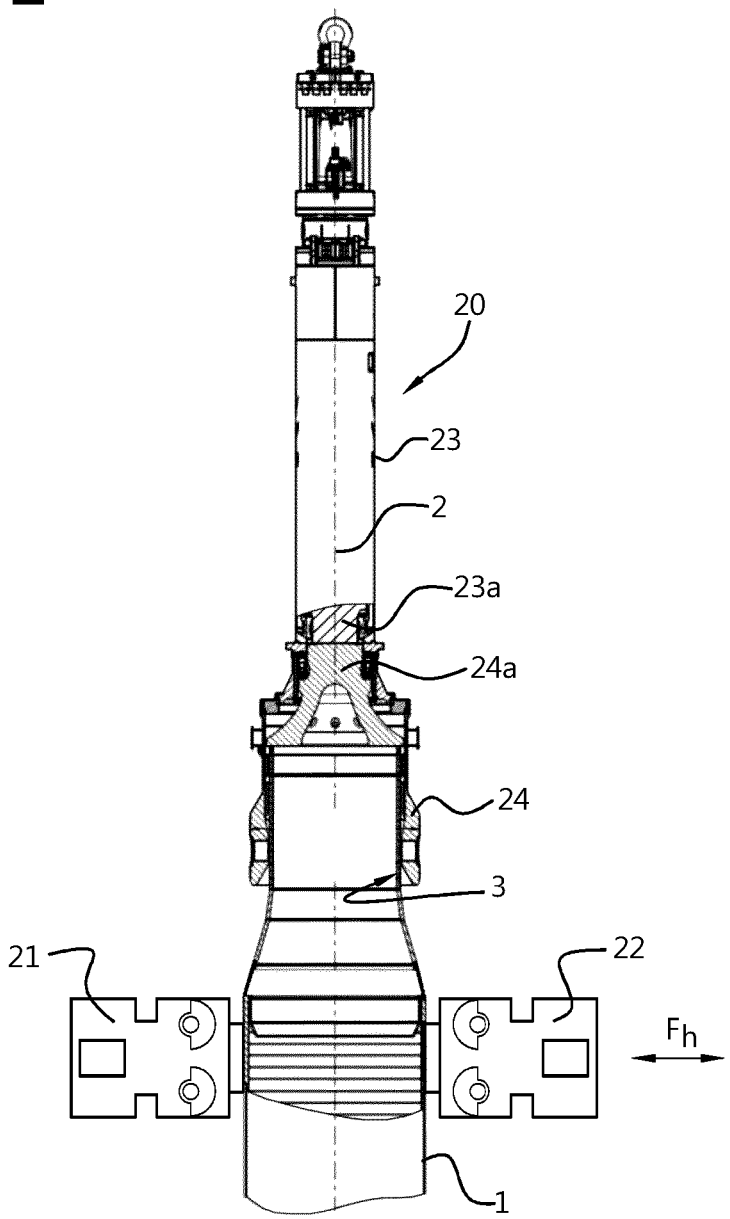
FIG. 2 schematically illustrates the third aspect of the invention.

As depicted in FIG. 1 these pile driver devices 11-18 that create the resultant vertical force F that is offset from the vertical centreline 2 of the tubular pile 1 and travels about the vertical centreline may be all the devices used for driving the pile 1 into the soil. In another embodiment, one or more additional pile driving devices are employed simultaneously. For example, a single (large capacity) drop weight type pile driver devices is also used, e.g. as illustrated in FIG. 2. In another example, one or more further vibratory pile driver devices are employed that do have a resultant force that does coincide with the centreline of the pile, e.g. as illustrated in FIG. 2.

In a practical embodiment, the pile driving system 10 comprises a controller that monitors the phase of each of the multiple vibratory pile driver devices 11-18 that are operated to exert their alternating vertical forces out of phase, which controller further allows for adjustment of the out of phase operation of the devices 11-18. As is known in the art, the controller may also allow for adjustment of the vibration frequency, for example.

In a practical embodiment, the motion of the top end 3 of the pile 1 in the horizontal plane is monitored, e.g. to monitor and/or control the operation of the pile driver devices 11-18 that create the resultant vertical force F that is offset from the vertical centreline 2 of the tubular pile and travels about the vertical centreline. For example, such monitoring is done use (laser) distance measuring equipment, and/or inertia based measuring equipment, etc.

The FIG. 1 may also be considered as a schematic illustration of another method according to the second aspect of the invention, wherein the pile driving system 10 comprises multiple drop weight pile driver devices 11-18 in a circular array engaging and independently from one another on the top end of the pile. Herein each pile driver device 11-18 is configured to transfer energy from the respective drop weight to the top of the pile at a respective frequency along a working line that is associated with the pile driver device, the energy transfers of the pile driver devices in combination creating a resultant vertical force having a resultant vertical force working line.

In accordance with the present second aspect of the invention, the multiple drop weight pile driver devices 11-18 are operated to perform their respective energy transfers out of phase in such a manner that the resultant vertical force is offset from the vertical centreline of the tubular pile and travels about the vertical centreline.

It will be appreciated that it is envisaged that this operation results in a reduced skin friction.

For example, the drop weight devices are each embodied as (hydraulically accelerated) drop weight impact hammer devices, as commonly used for (offshore) pile driving of piles.

With reference to FIG. 2 the third aspect of the invention is discussed.

The third aspect of the invention relates to a pile driving method for driving a hollow tubular pile 1 having a vertical centreline 2, a top end 3 and an open foot end vertically into the soil, e.g. into the seabed, e.g. a large diameter pile having an outer diameter at the open foot end of at least 5 meters, e.g. a monopile of an offshore wind turbine.

Use is made of a pile driving system 20, which pile driving system comprises one or more vibratory pile driver devices 21, 22 engaging on the top end of the pile, each of the vibratory pile driver devices 20, 21 being configured to apply an alternating force at a respective vibration frequency along a working line that is associated with the pile driver device.

According to the third aspect of the invention the one or more vibratory pile driver devices 21, 22 are configured and operated to have a horizontal working line so that a lateral vibratory force Fh is exerted on the top end 3 of the pile 1. So, the top end of the pile is effectively made to sway in a vertical plane in order to reduce skin friction.

The third aspect of the invention is based on the insight that, especially for large diameter piles, effectively inducing torsional vibrations may prove impractical. Making the pile 1 controllably sway in a vertical plane appears practical even for large diameter piles, e.g. by using a circular arrangement of such pile driver devices that operate in unison to create the controlled lateral vibration of the top end of the pile.

It is shown here, that two vibratory pile driver devices 21, 22 are mounted at diametrically opposed positions on the top end of the pile, the pair or devices 21, 22 being configured and operated to have a horizontal working line, e.g. a common working line, so that a lateral vibratory force Fh is exerted on the top end of the pile. One or more further vibratory pile driver devices may be mounted at other positions on the top end of the pile and have parallel working lines to assist in inducing the lateral vibration.

In order to provide the vertical pile driving force one or more additional pile driver devices are envisaged in combination with the one or more devices 21, 22. Here it is shown that a single (hydraulically accelerated) drop weight impact hammer device 23, as commonly used for (offshore) pile driving of pile, is used for provided (the majority of) the vertical pile driving force. The device 23 has a sleeve 24 that fits over the top end of the pile 1. The (accelerated) drop weight 23*a* falls onto an anvil 24*a* that is connected directly to the sleeve and is resting on the top of the pile 1.

Figure 3:
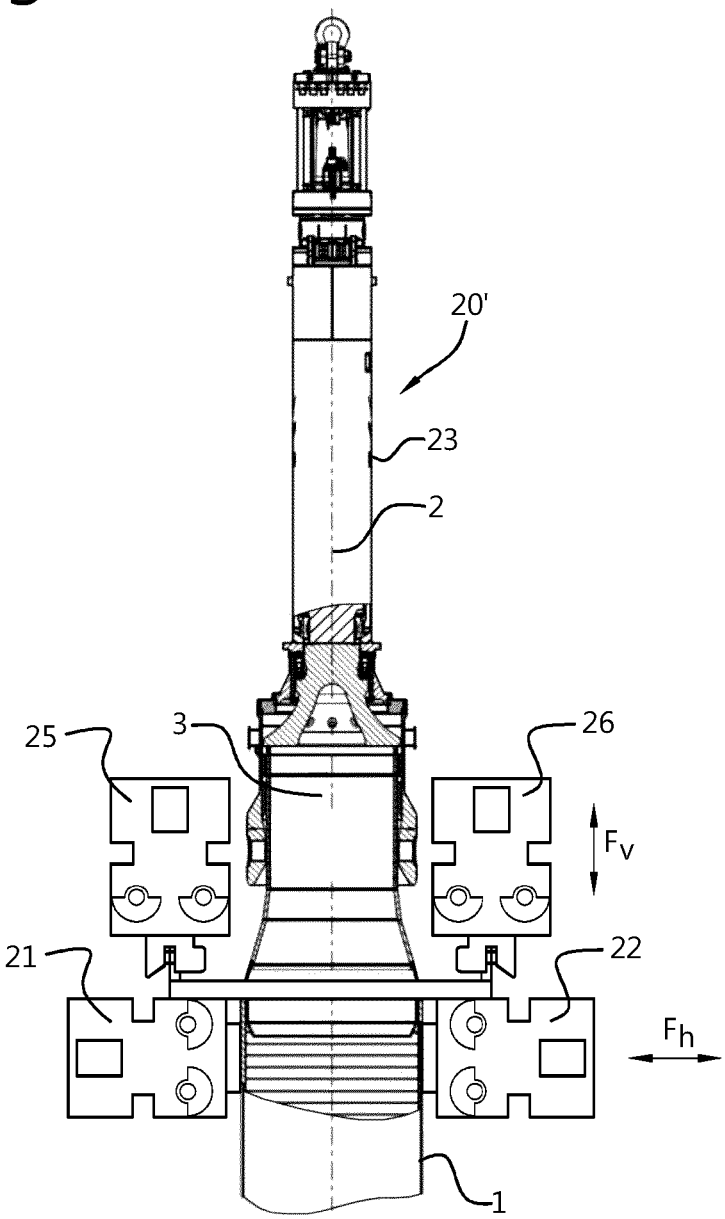
FIG. 3 schematically illustrates the fourth aspect of the invention.

With reference to FIG. 3 the fourth aspect of the invention is discussed.

The fourth aspect of the invention relates to a pile driving method for driving a hollow tubular pile 1 having a vertical centreline 2, a top end 3 and an open foot end vertically into the soil, e.g. into the seabed, e.g. a large diameter pile having an outer diameter at the open foot end of at least 5 meters, e.g. a monopile of an offshore wind turbine.

Use is made of a pile driving system 20', which pile driving system 20' comprises a drop weight pile driver device 23 engaging on the top end 3 of the pile, the drop weight pile driver device being configured to transfer energy from the respective drop weight 23*a* to the top of the pile, here via anvil 24*a*, at a respective frequency along a vertical working line.

In another embodiment, use is made of a system as disclosed in WO2020153838. In this document, systems are described that allow to create enormous pile driving energy for driving of a monopile into the soil. Generally, herein use is made of a very large mass that is dropped (without being accelerated other than via gravity). For example, the energy transfer is devoid of mechanical impact energy transfer.

The fourth aspect of the invention proposed a pile driving method, wherein use is made of a pile driving system that further comprises at least one vibratory pile driver device 21, 22, 25, 26 that is distinct from the drop weight pile driver device 23 and engages on the top end of the pile.

Each vibratory pile driver device 21, 22, 25, 26 is configured and operated simultaneously with the operation of at least one at least one drop weight pile driver device 23 to apply an alternating force Fh, Fv at a respective vibration frequency along a working line that is associated with the pile driver device 21, 22, 25, 26.

So, in the inventive method of the fourth aspect a combination of systems is used, the one being based on the presence of one or more drop weight pile driver devices 23 engaging on the top end of the pile, e.g. to provide all or the majority of the vertical pile driving energy, and the other one being based on the presence of one or more vibratory pile driver devices 21, 22, 25, 26 that are distinct from the one or more drop weight pile driver devices 23. The one or more vibratory pile driver devices 21, 22, 25, 26 may in practice be used predominantly to reduce skin friction between the pile and the soil, e.g. not contribution to the vertical pile driving energy or only to a lesser degree than the one or more drop weight pile driver devices 23.

It is illustrated, by way of example, that the vibratory pile driver devices 21, 22 provide the above-mentioned lateral vibration of the third aspect of the invention.

It is illustrated that the vibratory pile driver devices 25, 26 provide vertical vibrations.

As mentioned herein, both vertical and horizontal vibrations primarily serve to reduce skin friction between the pile and the soil. For example, the one or more vibratory pile driver devices 21, 22, 25, 26 provide vibrations at a higher frequency than the operation of the drop weight pile driver device 23 engaging on the top end of the pile 1.

Figure 4A:
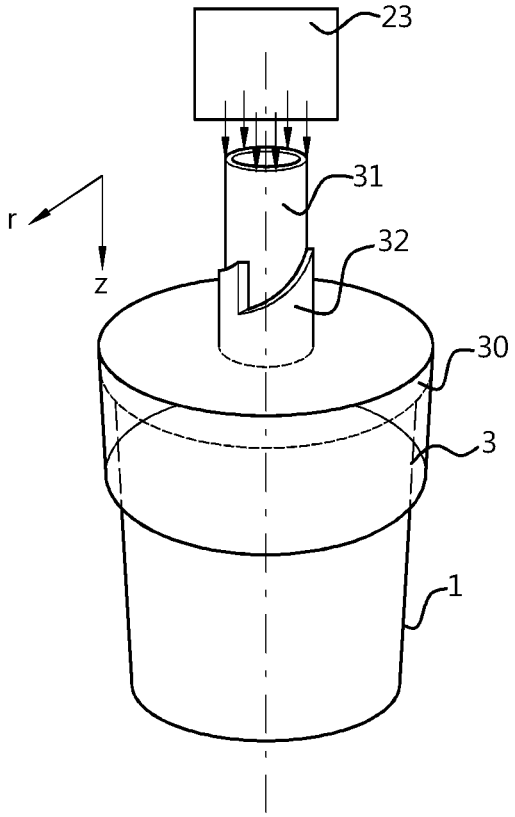
FIGS. 4*a, b* schematically illustrate the fifth aspect of the invention.
Figure 4B:
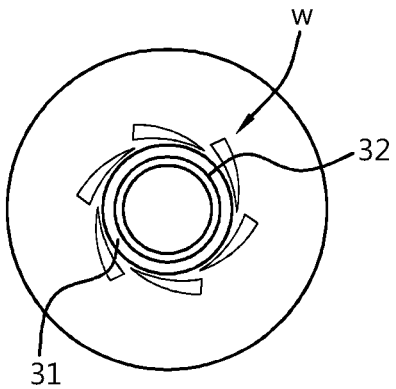

With reference to FIGS. 4*a*, 4*b* the fifth aspect of the invention is discussed.

The fifth aspect of the invention relates to a pile driving method for driving a hollow tubular pile 1 having a vertical centreline, a top end 3 and an open foot end vertically into the soil, e.g. into the seabed, e.g. a large diameter pile having an outer diameter at the open foot end of at least 5 meters, e.g. a monopile of an offshore wind turbine, wherein use is made of a pile driving system.

The pile driving system comprises a drop weight pile driver device 23 engaging on the top end of the pile 1, the drop weight pile driver device 23 being configured to transfer energy from the respective drop weight to the top of the pile at a respective frequency along a vertical working line, an energy transfer assembly 30 that is configured for transfer of energy from the falling drop weight 23*a* to the top end of the pile 1.

The fifth aspect of the invention proposes a pile driving method wherein the energy transfer assembly 30 is configured and operated to convert a fraction of the energy from the falling drop weight 23*a* into a torsional stress wave that is exerted on the top end 3 of the pile 1.

The fifth aspect of the invention is based on the insight that the torsional stress wave, which might also be considered a sound wave, can be created out of a wave travelling axially, vertically as can be observed when the energy from the falling drop weight travels to the top end of the pile. In fact, a fraction is then converted into the torsional stress wave, the rest continuing as axial, vertical, wave.

In an embodiment, as schematically shown, the energy transfer assembly 30 comprises a tubular section 31 through which the energy from the falling drop weight 23*a* travels to the top end 3 of the pile, with said section 31 having a spiralling increased wall thickness portion 32 that causes the creation of the torsional stress wave. This wave is schematically shown in FIG. 4*b* and indicated with 'w'. This section 31 is connected to the top end of the pile, so that both the torsional stress wave and the axial, vertical stress wave are transmitted to the top end of the pile 1.

According to the sixth aspect of the invention, the pile driving system 201 comprises an impact hammer 203, a vibratory drive 204 and a floating support 205.

The impact hammer is mounted on the top end of the hollow tubular pile 202, the pile having a centre line having a vertical centreline 206, a top end 207 and an open foot end vertically into the soil (not depicted), e.g. into the seabed. The pile 202 is a large diameter pile having an outer diameter at the open foot end of at about 12 meters, and is a monopile for supporting an offshore wind turbine.

The impact hammer 203 is configured for generating an axial pile driving force along a pile drive axis 208. Because the impact hammer is mounted on the pile 202, the pile drive axis 8 is aligned with the vertical centreline 206 of the pile 202.

In the embodiment shown, the impact hammer comprises an anvil 209, via which it is mounted on the top end of the pile.

The vibratory drive 204 is configured for generating an alternating force about the pile drive axis 208 at a vibration frequency, to vibrate the pile 202 about the vertical centreline 206 and reduce friction between the pile and the seafloor.

In the embodiment shown, the vibratory drive 204 is configured as an annular frame, the annular frame 210 comprising multiple vibratory pile driver devices 211. The annular frame is depicted in partial cross section.

In the embodiment shown, the vibratory drive 204 is mounted to the impact hammer, more in particular to the anvil 209 of the impact hammer.

The floating support is configured to allow free movement of the vibratory drive 204 along the pile drive axis to prevent the direct transfer of impact forces from the impact hammer to the vibratory drive, and to limit, preferably prevent, free movement of the vibratory drive about the pile drive axis to enable direct transfer of the torsional forces from the torsional drive to the impact hammer or the pile.

Figure 5:
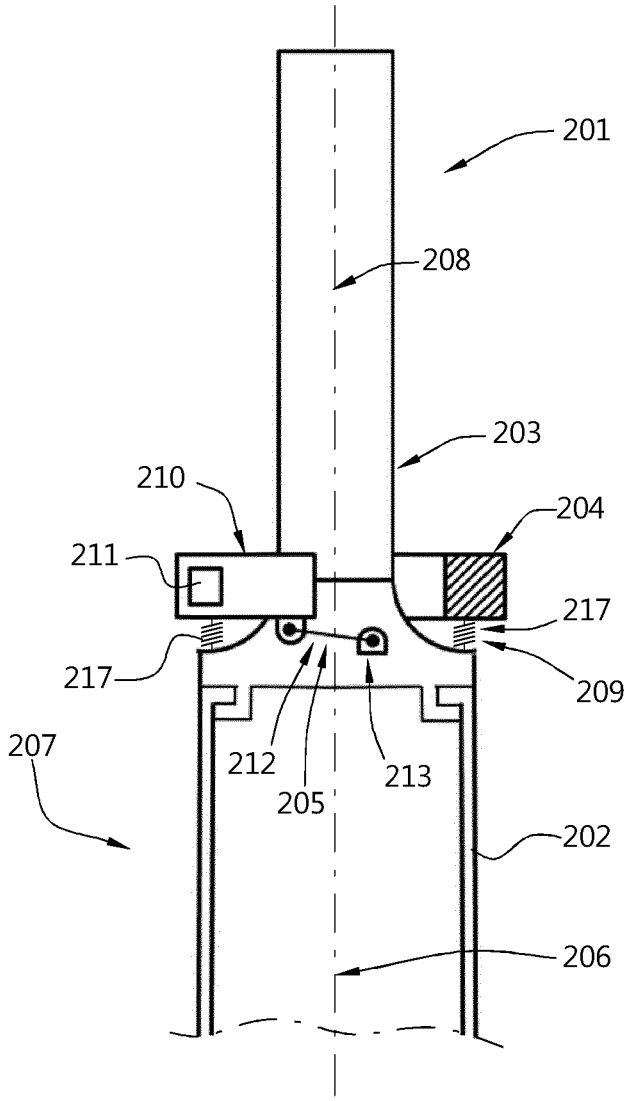
FIG. 5 shows a schematical side view in partial cross section of an exemplary embodiment of a pile driving system 201 according to a sixth aspect of the invention on a pile 202.
Figure 6:
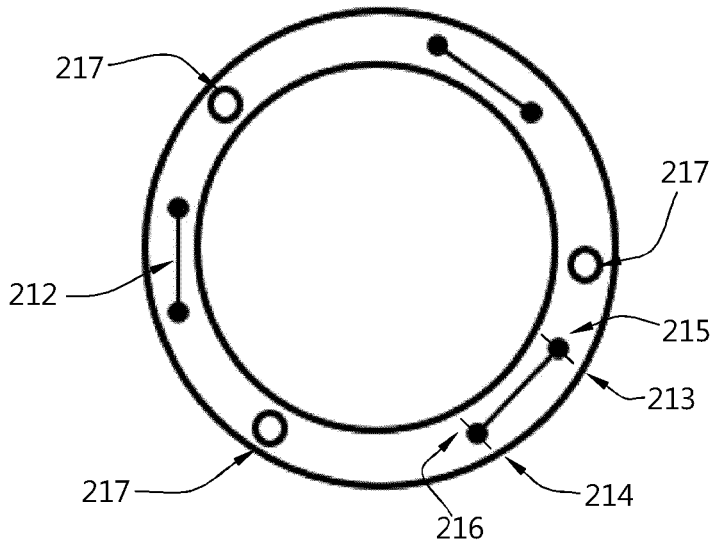
FIG. 6 shows a top view of part of the pile driving system of FIG. 5.
Figure 7:
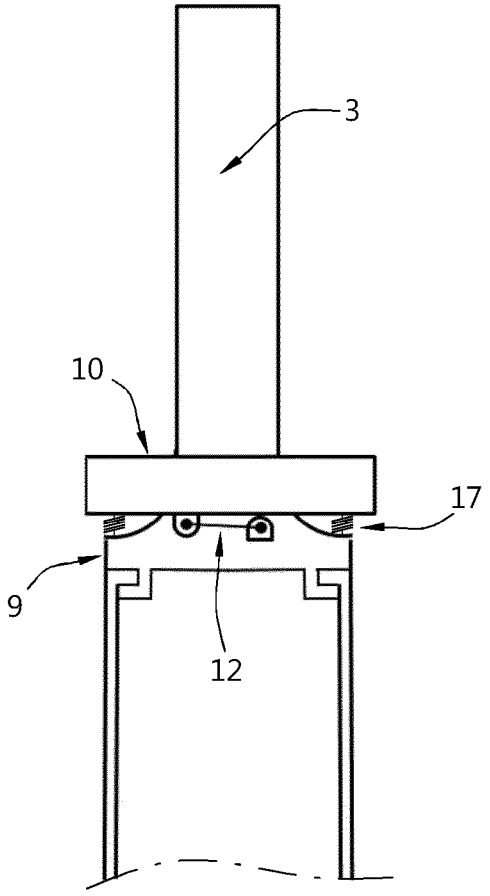
FIG. 7 shows the pile driving system of FIG. 5 in a first working condition, with resilient bodies 217 compressed and the support arms pivoted downwards.
Figure 8:
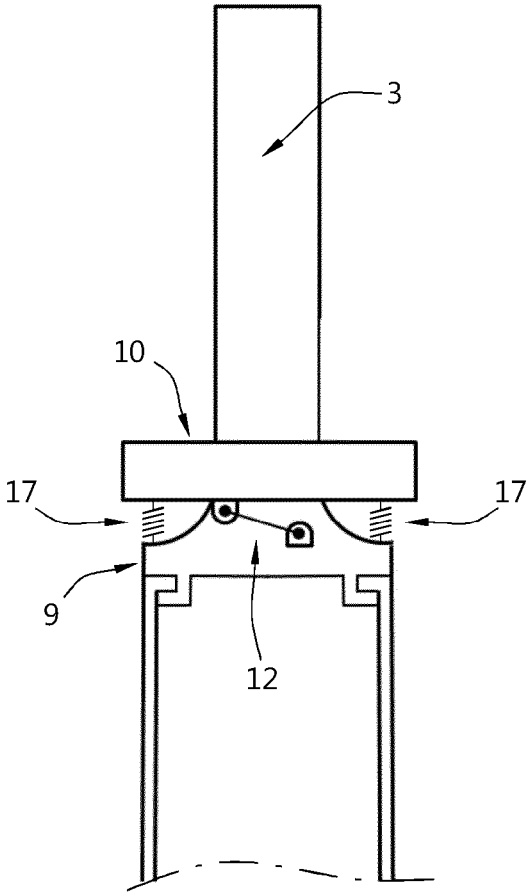
FIG. 8 shows the pile driving system of FIG. 5 in a second working condition, with resilient bodies 217 extended and the support arms pivoted upwards.

In the particular embodiment shown, the floating support comprises multiple support arms 212, of which only one is shown in FIG. 5. The multiple support arms 212 each have a base end 213 and a support end 214. The he support arms are at their base end provided with a pivot axis 215 and at their support end support the vibratory drive, in the embodiment shown the annular frame of the vibratory drive 204. In the embodiment shown, the support arms are pivotable mounted to the anvil at their base end and are pivotable mounted to the frame of the vibratory drive at their support end. Furthermore, in the embodiment shown, the support arms extend substantially tangential to a circle having the centreline at its centre. FIG. 6 shows a schematic top view of the anvil and the three support arms of the floating support.

Furthermore, in the embodiment shown, the floating support comprises multiple resilient bodies 217, in the embodiment shown embodied as hydraulic cylinders linked to a gas buffer. The resilient bodies 217 are mounted between the anvil 209 and the annular frame 210 of the floating support.

The resilient bodies thus allow for free movement of the vibratory drive along the pile drive axis to prevent the direct transfer of impact forces from the impact hammer to the vibratory drive.

In the embodiment shown, the resilient bodies support the annular frame such that, when the system is in rest (as depicted), the support arms are in a substantially horizontal position. The resilient bodies can extend to compensate of a sudden acceleration of the impact hammer, and can, subsequently be compressed to slow down the annular frame when it follows the pile in the downward direction, but the pile has slowed down or stopped. Thus, the floating support prevents excessive accelerations and decelerations of the vibratory drive during the pile driving process.

The support arms limit, preferably prevent, free movement of the vibratory drive about the pile drive axis and thus enable direct transfer of the torsional forces from the torsional drive to the impact hammer, and via the impact hammer to the pile.

Figure 9:
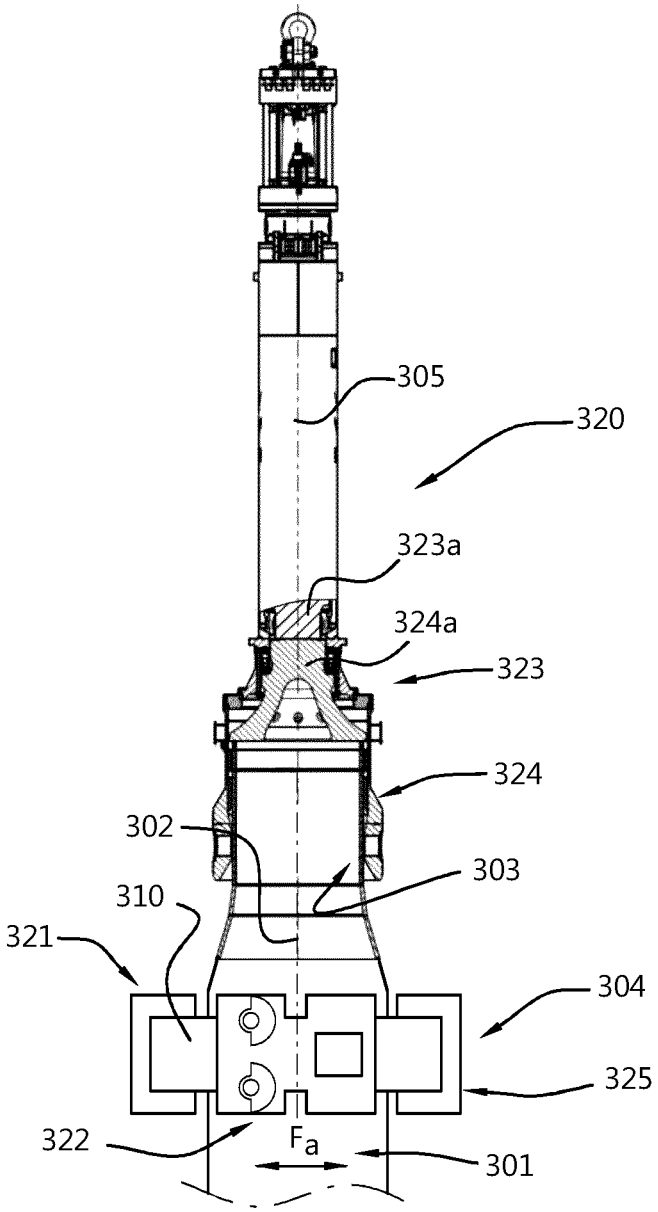
FIG. 9 schematically illustrates the first aspect of the invention.

With reference to FIG. 9 the first aspect of the invention is discussed.

The first aspect of the invention relates to a pile driving system for driving a hollow tubular pile 301 having a vertical centreline 302, a top end 303 and an open foot end vertically into the soil, e.g. into the seabed, e.g. a large diameter pile having an outer diameter at the open foot end of at least 5 meters, e.g. a monopile of an offshore wind turbine.

Use is made of a pile driving system 320. In the embodiment shown, the pile driving system 320 comprises a hammer device 323 embodied as a drop weight pile driver device. The hammer device engages on the top end 303 of the pile. The drop weight pile driver device is configured to transfer energy from the respective drop weight 323*a* to the top of the pile, here via anvil 324*a*, at a respective frequency along a vertical working line.

The first aspect of the invention proposed a pile driving system, wherein use is made of a pile driving system that further comprises a torsional vibration drive 304 that comprises at least one vibratory pile driver device. In the embodiment shown, the torsional vibration drive 304 is distinct from the hammer device 323, and engages on the top end of the pile.

The torsional vibration drive 304 is configured for generating an alternating force Fa about the pile drive axis 305 at a vibration frequency, to vibrate the pile 301 about the vertical centreline 302 and reduce friction between the pile and the seafloor.

In the embodiment shown, the torsional vibration drive 304 comprises four vibratory pile driver devices 321, 322, 325, three of which are shown, that are configured in a ring about the pile.

Furthermore, in the embodiment shown, the torsional vibration drive 304 is configured as an annular frame, the annular frame 310 comprising the four vibratory pile driver devices 321, 322, 325.

Each vibratory pile driver device 321, 322, 325 is configured and operated simultaneously with the operation of at least one at least one drop weight pile driver device 323 to apply an alternating force Fa at a respective vibration frequency about a pile drive axis 305, which pile drive axis coincides with the central longitudinal axis of the pile So, in the inventive method of the first aspect a combination of systems is used. One being based on the presence of at least one hammer device 323 engaging on the top end of the pile, e.g. to provide all or the majority of the vertical pile driving energy, and the other one being based on the presence of a torsional vibration drive 304. The torsional vibration drive 304 comprises one or more vibratory pile driver devices 321, 322, 325 that in practice are used to reduce skin friction between the pile and the soil, and that do not contribute to the vertical pile driving energy.

It is illustrated, by way of example, that the vibratory pile driver devices 321, 322, 325 provide the above-mentioned alternating force Fa at a respective vibration frequency about the pile drive axis.

As mentioned herein, horizontal vibrations about the pile drive axis primarily serve to reduce skin friction between the pile and the soil. For example, the one or more vibratory pile driver devices 321, 322, 325 provide vibrations at a higher frequency than the operation of the drop weight pile driver device 323 engaging on the top end of the pile 301.

Thus, in the embodiment shown, the hammer device 323 is mounted on the top end of the hollow tubular pile 301, the pile having a vertical centreline 302, a top end 303 and an open foot end vertically into the soil (not depicted), e.g. into the seabed. The pile 301 is a large diameter pile having an outer diameter at the open foot end of at about 12 meters, and is a monopile for supporting an offshore wind turbine.

In the embodiment shown, the hammer device 323 is embodied as an impact hammer. The hammer device 323 is configured for generating an axial pile driving force along a pile drive axis 305. Because the impact hammer is mounted on the pile 301, the pile drive axis 305 is aligned with the vertical centreline 302 of the pile.

Furthermore, in the embodiment shown the torsional vibration drive 304 is connected to the pile 301 via a floating support. The floating support is provided between, and is connected to, the annular frame of the torsional vibration drive and the foundation pile. The floating support is configured to allow free movement of the torsional vibration drive along the pile drive axis 305 to prevent the direct transfer of energy from the hammer device 323 to the torsional vibration drive, and to limit, preferably prevent, free movement of the torsional vibration drive about the pile drive axis to enable direct transfer of the torsional forces from the torsional vibration drive to the hammer device or the pile.

It is submitted that the floating support can be embodied as the floating support discussed with respect to the sixth aspect of the invention, and for example shown in FIGS. 5 to 8.

The floating support is configured to allow free movement of the torsional vibration drive along the pile drive axis to prevent the direct transfer of impact forces from the impact hammer to the torsional vibration drive, and to limit, preferably prevent, free movement of the torsional vibration drive about the pile drive axis to enable direct transfer of the torsional forces from the torsional drive to the impact hammer or the pile.

In an embodiment, the floating support comprises multiple support arms, that each have a base end and a support end, that connect the annular frame of the torsional vibration drive to the pile. The support arms are pivotable mounted to the top end of the pile at their base end and are pivotable mounted to the frame of the torsional vibration drive at their support end.

In a further embodiment, the support arms extend substantially tangential to a circle having the pile drive axis at its centre, for example like the configuration schematically shown in FIG. 6. Furthermore, the floating support preferably comprises multiple resilient bodies, not shown in the figure, for example embodied as hydraulic cylinders linked to a gas buffer. The resilient bodies are for example mounted between the pile and the annular frame of the floating support to dampen vertical movement of the torsional vibration drive relative to the hammer device.

Figure 10:
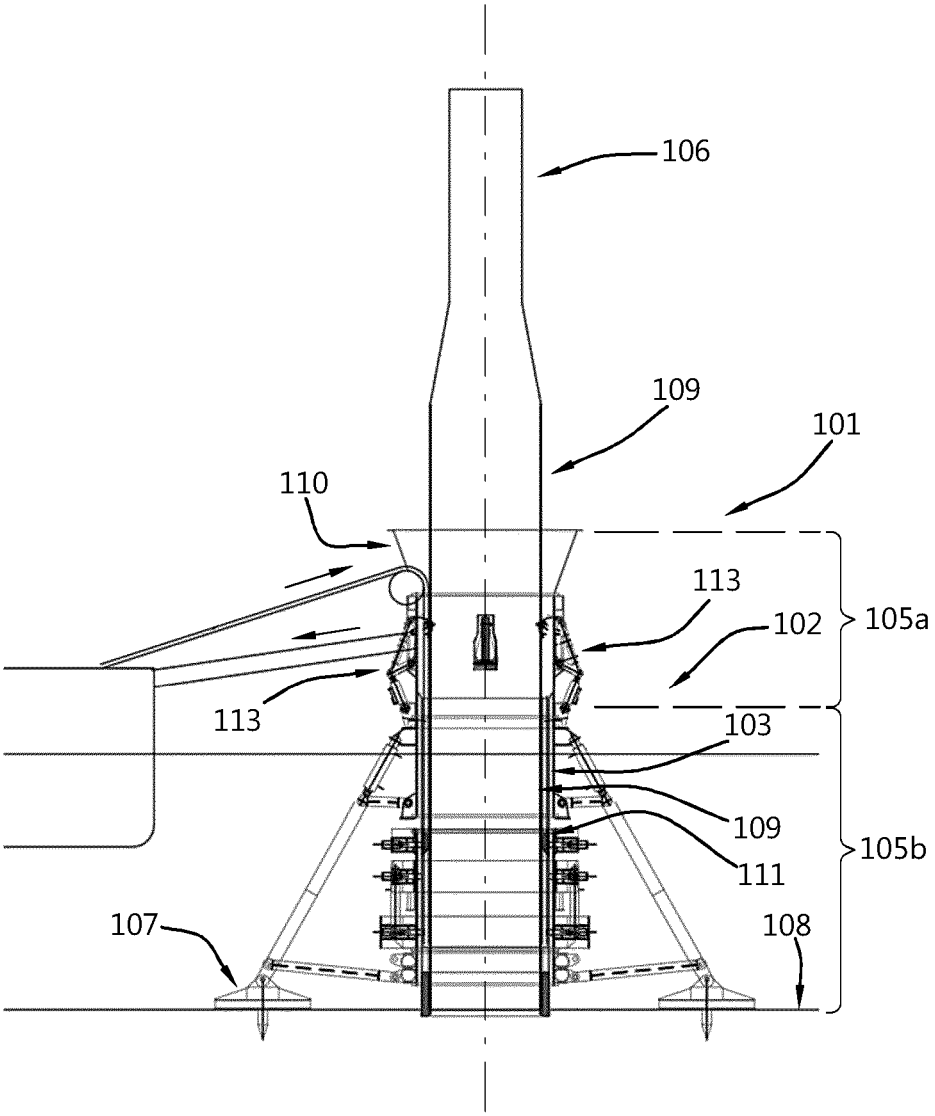
FIG. 10 shows a side view in cross section of an exemplary embodiment of a pile installation device according to the eight aspect of the invention.
Figures 11A, 11B, 11C, 11D, 11E, 11F:
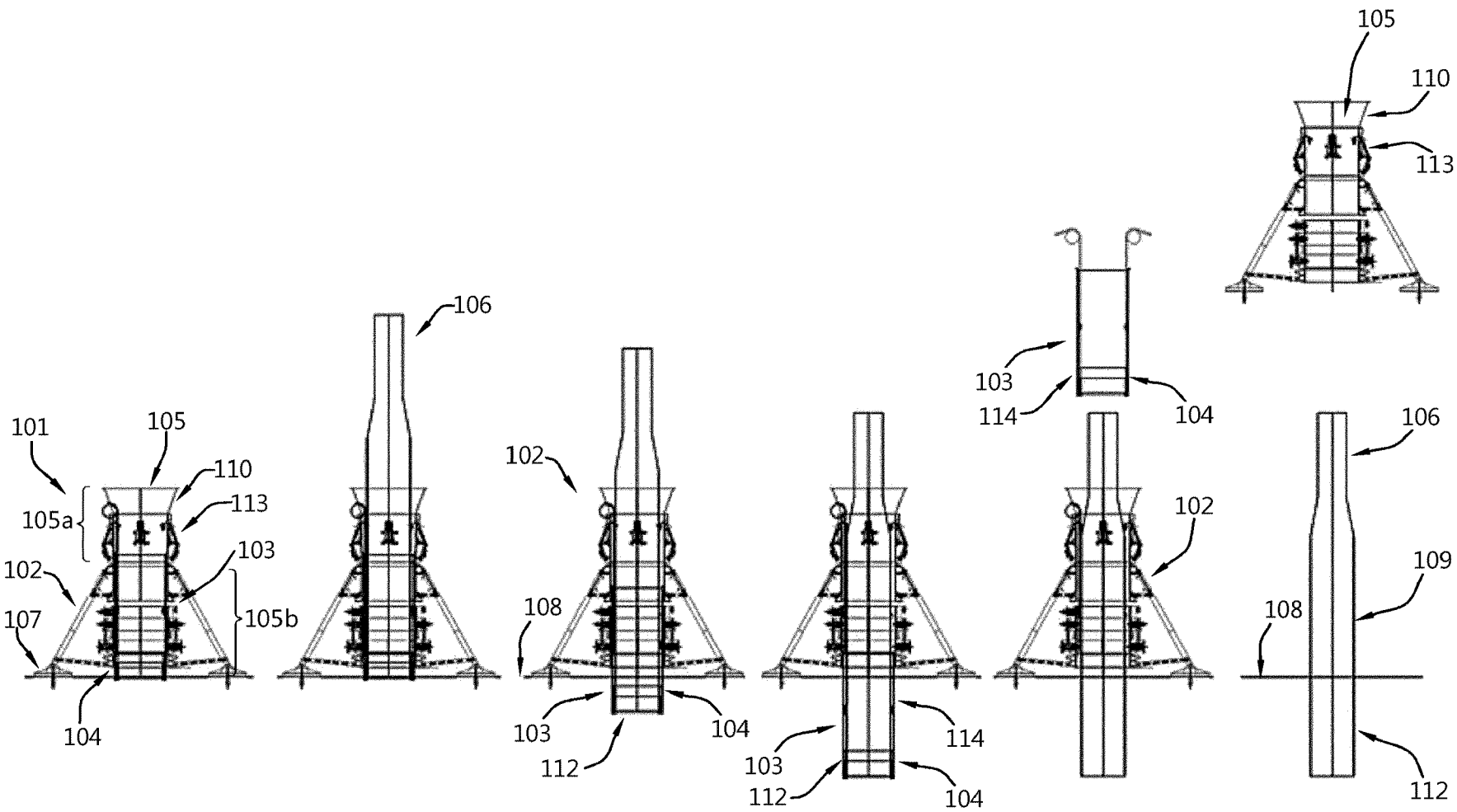
FIG. 11A-11F show different steps of a method according to the eighth aspect of the invention using the pile installation device of FIG. 10, wherein the pile installation device is shown in cross section.

FIG. 10 shows a side view in cross section of an exemplary embodiment of a pile installation device 101 according to the eighth aspect of the invention. FIG. 11A 11F show different steps of a method according to the eighth aspect of the invention using the pile installation device of FIG. 10, wherein the pile installation device is shown in cross section.

The pile installation device 101 comprises a support frame 102, a pile liner 103, a pile drill 104 and a pile guide 105.

FIG. 11*a* shows the pile installation device set up on the seabed, ready to receive a foundation pile. FIG. 11*b* shows the pile installation device of FIG. 11*a* supporting a foundation pile 106. FIG. 11*c* shows the foundation pile being lowered into the sea floor.

FIG. 11E shows the pile liner 103 and the pile drill 104 being lifted form the pile hole, and the foundation pile 106 lowered into the installed position. FIG. 11*f* shows the foundation installation device, more in particular the support frame 102 and the pile guide 105, being removed 101, i.e. being lifted, leaving the foundation pile in the installed position.

The support frame 102 is configured to be set up on the seabed 108. In the exemplary embodiment of the pile installation device 101 shown in FIG. 10, the support frame 102 is provided with three feet 107, two of which are depicted, for lateral support of the foundation pile. The feet 107 are provided with spikes to secure there position on the seabed.

The pile liner 103 for receiving a pile is configured to form a space between the liner and an outside surface 109 of the foundation pile 106, which is received in the liner. In the particular embodiment shown, the liner is provided with spacers 111 that center the foundation pile 106 in the pile liner 103, and thus create the space between the pile and the pile liner.

In an embodiment, the spacers can be adjustable, to thus enable them to center piles of different sizes in the pile liner.

The pile guide 105 is held in the support frame 102, in the embodiment shown is hold in the pile guide 105, which pile guide is configured for guiding the pile 106 and the pile liner 103. It is submitted that during the drilling process, the pile liner 103 moves with the foundation pile 106 into the pile hole 112 that is created by the pile drill 104. This is depicted in FIGS. 11*c* and 11*d*.

In the embodiment shown, the pile guide 105 comprises an upper section 105*a* and a lower section 105*b*. The upper section 105*a* of the pile guide is provided with one or more pile engagement devices 113, for engaging and guiding the foundation pile received in the pile installation device. The lower section 105*b* is configured for guiding the pile liner 103, and thus the foundation pile 106 received in the pile liner, while the pile liner is lowered with the foundation pile into the seabed during the installation process.

The pile drill 104 in the exemplary embodiment shown is an annular pile drill. The pile drill is combined with a drive module 114. The drill module 114 is provided on top of the annular drill frame that supports the multiple drill bits.

In the exemplary embodiment shown, the pile installation device 101 is provided with a funnel shaped centraliser 110 for guiding lower end pile into the pile guide.

The invention can be summarized according to one or more of the following clauses:

1. Pile driving method for driving a hollow tubular pile having a vertical centreline, a top end and an open foot end vertically into the soil, e.g. into the seabed, e.g. a large diameter pile having an outer diameter at the open foot end of at least 5 meters, e.g. a monopile of an offshore wind turbine, wherein use is made of a pile driving system, which pile driving system comprises:
   multiple vibratory pile driver devices in a circular array and engaging independently from one another on the top end of the pile, each vibratory pile driver device being configured to apply an alternating vertical force at a respective vibration frequency along a working line that is associated with the pile driver device, the alternating vertical forces in combination creating a resultant vertical force having a resultant vertical force working line, wherein the multiple vibratory pile driver devices are operated to exert their alternating vertical forces out of phase in such a manner that the resultant vertical force is offset from the vertical centreline of the tubular pile and travels about the vertical centreline.

2. Pile driving method for driving a hollow tubular pile having a vertical centreline, a top end and an open foot end vertically into the soil, e.g. into the seabed, e.g. a large diameter pile having an outer diameter at the open foot end of at least 5 meters, e.g. a monopile of an offshore wind turbine, wherein use is made of a pile driving system, which pile driving system comprises:
   multiple drop weight pile driver devices in a circular array engaging independently from one another on the top end of the pile, each pile driver device being configured to transfer energy from the respective drop weight to the top of the pile at a respective frequency along a working line that is associated with the pile driver device, the energy transfers of the pile driver devices in combination creating a resultant vertical force having a resultant vertical force working line, characterized in that the multiple drop weight pile driver devices are operated to perform their respective energy transfers out of phase in such a manner that the resultant vertical force is offset from the vertical centreline of the tubular pile and travels about the vertical centreline.

3. Pile driving method for driving a hollow tubular pile having a vertical centreline, a top end and an open foot end vertically into the soil, e.g. into the seabed, e.g. a large diameter pile having an outer diameter at the open foot end of at least 5 meters, e.g. a monopile of an offshore wind turbine, wherein use is made of a pile driving system, which pile driving system comprises:
   a vibratory pile driver devices engaging on the top end of the pile, the vibratory pile driver device being configured to apply an alternating force at a respective vibration frequency along a working line that is associated with the pile driver device, characterized in that the vibratory pile driver device is configured and operated to have a horizontal working line so that a lateral vibratory force is exerted on the top end of the pile.

4. Pile driving method for driving a hollow tubular pile having a vertical centreline, a top end and an open foot end vertically into the soil, e.g. into the seabed, e.g. a large diameter pile having an outer diameter at the open foot end of at least 5 meters, e.g. a monopile of an offshore wind turbine, wherein use is made of a pile driving system, which pile driving system comprises:
   a drop weight pile driver device engaging on the top end of the pile, the drop weight pile driver device being configured to transfer energy from the respective drop weight to the top of the pile at a respective frequency along a vertical working line, characterized in that at least one vibratory pile driver device distinct from the drop weight pile driver device engages on the top end of the pile, each vibratory pile driver device being configured and operated simultaneously with the operation of at least one at least one drop weight pile driver device to apply an alternating force at a respective vibration frequency along a working line that is associated with the pile driver device.

5. Pile driving method for driving a hollow tubular pile having a vertical centreline, a top end and an open foot end vertically into the soil, e.g. into the seabed, e.g. a large diameter pile having an outer diameter at the open foot end of at least 5 meters, e.g. a monopile of an offshore wind turbine, wherein use is made of a pile driving system, which pile driving system comprises:
   a drop weight pile driver device engaging on the top end of the pile, the drop weight pile driver device being configured to transfer energy from the respective drop weight to the top of the pile at a respective frequency along a vertical working line,
   an energy transfer assembly configured for transfer of energy from the falling drop weight to the top end of the pile, characterized in that the energy transfer assembly is configured and operated to convert a fraction of the energy from the falling drop weight into a torsional stress wave that is exerted on the top end of the pile.

6. Foundation pile installation device, the foundation pile installation device comprising:
   a support frame, configured to be set up on the seabed, the support frame preferably comprising three or more adjustable feet for adjusting the position of the support frame on the sea bed;
   a pile liner for receiving a pile, and for moving with the pile while the pile is lowered into the seabed, wherein the pile liner preferably is configured to form a space between the liner and a foundation pile received in the liner;
   a pile drill, preferably an annular pile drill, provided at the lower end of the pile liner for drilling a pile hole that can receive the liner and the foundation pile received in the liner; and
   a pile guide, held in the support frame, for guiding a pile and/or the pile liner wherein a foundation pile is received, during a pile installation process, i.e. while the pile and the pile liner are lowered into the seabed.

7. Foundation installation device according to the preceding clause, wherein the pile guide comprises an upper section provided with one or more pile engagement devices, for engaging and guiding a foundation pile received in the pile installation device, and a lower section configured for guiding the pile liner, and thus a foundation pile received in the pile liner, while the pile liner is lowered with the foundation pile into the seabed during the installation process.

8. Method for installation of a wind turbine foundation pile, preferably using a pile installation device according to the preceding clauses, wherein the method comprises the steps:

setting the pile installation device on the seabed;

lowering a foundation pile into the pile guide of the installation device, and into a pile liner received in the pile guide;

drilling a pile hole at the lower end of the pile liner and the foundation pile received in the pile liner, and lowering the pile drill, pile liner and foundation pile into the pile hole;

removing the pile liner and the pile drill from the pile hole, optionally cementing a space created by removal of the pile liner and pile drill; and removing the pile installation device.

9. Pile driving system for driving a hollow tubular pile having a vertical centreline, a top end and an open foot end vertically into the soil, e.g. into the seabed, e.g. a large diameter pile having an outer diameter at the open foot end of at least 5 meters, e.g. a monopile of an offshore wind turbine, wherein use is made of a pile driving system, wherein the pile driving system comprises:

an impact hammer, for generating an axial pile driving force along a pile drive axis, wherein the pile drive axis is to be aligned with the vertical centreline of the pile, to drive the pile into the seafloor;

a vibratory drive, for generating an alternating force about the pile drive axis at a vibration frequency, to vibrate the pile about the vertical centreline and reduce friction between the pile and the seafloor; and a floating support that connects the vibratory drive to the impact hammer, or that is configured to connect the vibratory drive to the pile, wherein the floating support is configured to allow free movement of the vibratory drive along the pile drive axis to prevent the direct transfer of impact forces from the impact hammer to the vibratory drive, and to limit, preferably prevent, free movement of the vibratory drive about the pile drive axis to enable direct transfer of the torsional forces from the torsional drive to the impact hammer or the pile.

10. Pile driving system according to clause 9, wherein the floating support allows for movement along the pile drive axis of the vibratory drive relative impact hammer over a range of at least 20 cm, preferably at least of at least 40 cm, for example 60 cm or more.

11. Pile driving system according to clause 9 or clause 10, wherein the floating support is configured to dampen the impact forces while being transferred from the impact hammer to the vibratory drive, for example is provided with one or more resilient bodies, e.g. one or more springs or cylinders, between the impact hammer and the vibratory drive.

12. Pile drive system according to one or more of the clauses 9-11, wherein the floating support is provided with dampening means, which dampening means reduce the relative motion of the vibratory drive when one or both limits of the relative movement allowed by the floating support is or are reached.

13. Pile driving system according to clause 12, wherein the dampening means have a working trajectory, i.e. the trajectory wherein the reduce the relative speed of the vibratory drive, of multiple decimeters, for example have a working trajectory of at least 20 cm preferably of more than 30 cm, for example have a working trajectory of at least 40 cm.

14. Pile driving system according to clause 12 or clause 13, wherein the dampening means comprise one or more hydraulic cylinders coupled with a gas buffer, and wherein the hydraulic cylinders preferably have a working trajectory of 30 cm.

15. Pile driving system according to one or more of the clauses 9-14, wherein the torsional drive comprises multiple vibratory pile driver devices arranged in a circular array around the pile drive axis, wherein each vibratory pile driver is configured to apply an alternating force, in a plane perpendicular to the vertical centre line of the pile, at a vibration frequency to vibrate the pile about the vertical centreline.

16. Pile driving system according to one or more of the clauses 9-15, wherein the impact hammer generates an impact force at a pile driving frequency, and wherein the vibratory drive generates a torsional force at a torsion frequency, and wherein the torsion frequency is at least five times, preferably at least ten times, for example is at least twenty times, the pile driving frequency.

17. Pile driving system according to one or more of the clauses 9-16, wherein the floating support comprises an annular frame configured to, in a working condition, extend about the pile drive axis, and wherein the vibratory drive, e.g. multiple vibratory pile driver devices, are mounted to the annular frame.

18. Pile driving system according to one or more of the clauses 9-17, wherein the floating support comprises multiple support arms, each arm having a base end and a support end, wherein the support arms are at their base end provided with a pivot axis and at their support end support the vibratory drive, preferably each support arm supporting a vibratory pile driver device at the support end of the support arm.

19. Pile driving system according to clause 18, wherein the pivot axis of each support arm extends in a plane perpendicular to the pile drive axis.

20. Pile driving system according to clause 18 or clause 19, wherein the pivot axis of each support arm extends in a plane parallel to the pile drive axis.

21. Pile driving system according to one or more of the clauses 18-20, wherein the pivot axis of each support arm extends in a radial direction relative to the pile drive axis 22. Pile driving system according to one or more of the clauses 9-21, wherein the pivot axis of each support arm extends perpendicular to a longitudinal axis of the support arm 23. Pile driving system according to one or more of the clauses 18-22, wherein the floating support comprises multiple flexible support arms, each flexible support arm having a base end and a support end, wherein the flexible support arms at their support end support the vibratory drive, preferably each flexible support arm supporting a vibratory pile driver device at the support end of the flexible support arm.

24. Pile driving system according to one or more of the clauses 18-23, wherein, when seen in a top view, the support arms are tangent to a circle having the pile drive axis at its centre.

25. Pile driving system according to clause 18 or clause 23, wherein, when seen in a top view, the support arms extend in a radial direction relative to the pile drive axis.
26. Pile driving system according to one or more of the clauses 9-17, wherein the floating support comprises multiple linkage systems, each linkage system having a base linkage and a support linkage, wherein the linkage systems with their support linkage support the vibratory drive, preferably each linkage system supporting a vibratory pile driver with the support linkage, preferably such that the vibratory drive can move in a direction parallel to the pile drive axis.
27. Pile driving system according to one or more of the clauses 9-26, wherein the floating support comprises multiple fins and slots, extending parallel to the pile drive axis, such that the vibratory drive can move in a direction parallel to the pile drive axis.
28. Pile driving system according to one or more of the clauses 9-27, wherein the floating support comprises one or more resilient bodies, e.g. springs or cylinders, for resiliently supporting the vibratory drive in a direction parallel to the pile drive axis, and wherein the resilient bodies preferably are configured to dampen the impact forces while being transferred from the impact hammer to the vibratory drive.
29. Pile driving system according to one or more of the clauses 9-28, wherein the impact hammer is a gravity hammer, e.g. is a drop weight hammer.
30. Pile driving system according to one or more of the clauses 9-29, wherein the impact hammer is a forced impact hammer, preferably is a hydraulically forced impact hammer.
31. Pile driving system according to one or more of the clauses 9-30, wherein the impact hammer is a combination of multiple impact hammers, wherein the impact hammers are each configured to transfer energy to the pile at a frequency, and wherein the impact hammers are configured to be operated sequentially.
32. Pile driving system according to one or more of the clauses 9-31, wherein the pile drive comprises an anvil, which anvil is configured to be coupled with the top end of the foundation pile to transfer the axial pile driving force from the pile drive to the foundation pile.
33. Pile driving system according to clause 32, wherein the floating support is mounted to the anvil.
34. Pile driving system according to one or more of the clauses 9-32, wherein the floating support is mounted to the top end of the monopile, e.g. comprises a ring that is mounted on the top end of the of the pile.
35. Pile driving system according to one or more of the clauses 9-34, wherein the monopile is configured to be engaged by the floating support, for example is provided with radially extending teeth for cooperating with driving teeth of a floating support and/or is provided with seats at the top end of the monopile for receiving the floating support.
36. Pile driving system according to one or more of the clauses 9-35, wherein the floating support allows for movement of the vibratory drive relative impact hammer along the pile drive axis over a range of at least 20 cm, preferably at least of at least 40 cm, for example 60 cm or more
37. Vessel, e.g. a jack-up vessel, provided with a pile driving system according to one or more of the clauses 9-36.
38. Pile driving method for driving a hollow tubular pile having a vertical centreline, a top end and an open foot end vertically into the soil, e.g. into the seabed, e.g. a large diameter pile having an outer diameter at the open foot end of at least 5 meters, e.g. a monopile of an offshore wind turbine, wherein use is made of a pile driving system, preferably a pile driving system according to one or more of the preceding clauses, wherein the method comprises the steps:
   setting up the pile with the open foot in the sea floor, while supporting the pile above water in a radial direction using a pile guide mounted on a vessel, e.g. a jack up vessel.
   generating an axial pile driving force along a pile drive axis, using an impact hammer, wherein the pile drive axis is to be aligned with the vertical centreline of the pile, to drive the pile into the seafloor;
   generating a torsional force about the pile drive axis, using a vibratory drive, to rotate the pile about the vertical centreline to reduce friction between the pile and the seafloor; and
   allowing free movement of the vibratory drive along the pile drive axis to prevent the direct transfer of impact forces from the impact hammer to the vibratory drive, and limiting, preferably preventing, free movement of the vibratory drive about the pile drive axis to enable direct transfer of the torsional forces from the torsional drive to the impact hammer or the pile.

The invention claimed is:

1. A pile driving system for driving a hollow tubular pile having a central longitudinal axis, a top end, and an open foot end vertically into the soil, wherein the pile driving system comprises:
   at least one hammer device configured to transfer energy from the respective hammer device to the top of the pile at a respective frequency along a pile drive axis, wherein the pile drive axis is parallel to, the central longitudinal axis of the pile; and
   a torsional vibration drive,
   wherein the torsional vibration drive comprises at least one vibratory pile driver device, that engages on the pile or on the hammer device, and
   wherein each vibratory pile driver device of the torsional vibration drive is configured and operated simultaneously with the operation of the at least one hammer device to apply an alternating force at a respective vibration frequency about the pile drive axis.

2. The pile driving system according to claim 1, wherein a floating support connects the torsional vibration drive to the hammer device, or connects the torsional vibration drive to the pile, and wherein the floating support is configured to allow free movement of the torsional vibration drive along the pile drive axis to prevent the direct transfer of energy from the hammer device to the torsional vibration drive, and to limit free movement of the torsional vibration drive about the pile drive axis to enable direct transfer of the torsional forces from the torsional vibration drive to the hammer device or the pile.

3. The pile driving system according to claim 2, wherein the floating support allows for movement of the torsional vibration drive along the vertical working line relative to the hammer device over a range of at least 20 cm.

4. The pile driving system according to claim 2, wherein the floating support is configured to dampen impact forces generated by the at least one hammer device while being transferred from the hammer device to the torsional vibration drive.

5. The pile driving system according to claim 4, wherein the floating support is provided with one or more resilient bodies between the impact hammer or pile and the torsional vibration drive.

6. The pile drive system according to claim 4, wherein the floating support is provided with dampening means, the dampening means reducing motion of the torsional vibration drive along the pile drive axis and relative to the hammer device, wherein the motion is caused by the hammer device.

7. The pile driving system according to claim 6, wherein the dampening means have a working trajectory, i.e. the trajectory wherein they reduce the relative speed of the torsional vibration drive, of multiple decimetres.

8. The pile driving system according to claim 6, wherein the dampening means comprise one or more hydraulic cylinders coupled with a gas buffer.

9. The pile driving system according to claim 8, wherein the hydraulic cylinders have a working trajectory of 30 cm.

10. The pile driving system according to claim 1, wherein the pile driving system comprises multiple hammer devices, that are set up to apply a vertical force along a working line that is associated with the respective hammer device, and wherein the vertical forces in combination create a resultant vertical force having a resultant vertical force working line, and the vertical force working line is parallel to the pile drive axis.

11. The pile driving system according to claim 1, wherein the at least one hammer device is a vibratory hammer device, the vibratory hammer device being configured to transfer energy from the respective vibratory hammer device to the top of the pile at a respective frequency along the pile drive axis.

12. The pile driving system according to claim 1, wherein the at least one hammer device is a drop weight pile driver device engaging on the top end of the pile, the drop weight pile driver device being configured to transfer energy from the respective drop weight to the top of the pile at a respective frequency along the pile drive axis.

13. The pile driving system according to claim 1, wherein the torsional vibration drive comprises multiple vibratory pile driver devices, and wherein each vibratory pile driver device is configured to apply an alternating force, in a plane perpendicular to the pile drive axis, at a vibration frequency to vibrate the pile about the pile drive axis.

14. The pile driving system according to claim 13, wherein the multiple vibratory pile driver devices of the torsional vibration drive are arranged in a circular array around the pile drive axis.

15. The pile driving system according to claim 1, wherein the torsional vibration drive is distinct from the hammer device and is configured to engage the pile.

16. The pile driving system according to claim 1, wherein the torsional vibration drive is configured to apply torsional vibration loads with frequencies of at least 50 Hz.

17. The pile driving system according to claim 1, wherein the at least one hammer device is a vibratory hammer device and is configured to apply vibration loads along the pile drive axis with frequencies of at least 14 Hz.

18. The pile driving system according to claim 1, wherein the impact hammer device is configured to generate an impact force at a pile driving frequency, and wherein the torsional vibration drive generates a torsional force at a torsion frequency, and wherein the torsion frequency is at least three times the pile driving frequency.

19. The pile driving system according to claim 1, wherein the pile driving system comprises an anvil, the anvil being configured to be coupled with the top end of the foundation pile to transfer the axial pile driving force from the pile drive to the foundation pile.

20. The pile driving system according to claim 19, further comprising a floating support, wherein the floating support is mounted to the anvil.

21. The pile driving system according to claim 1, wherein the pile drive system comprises a sleeve for receiving a top end of the pile, wherein the sleeve is configured to be fixed to the pile against rotation about the longitudinal axis of the pile.

22. The pile driving system according to claim 21, further comprising a floating support, wherein the floating support is mounted to the sleeve.

23. The pile driving system according to claim 1, further comprising a floating support, wherein the floating support is mounted to the top end of a monopile.

24. Pile driving system according to claim 23, wherein the floating support comprises a ring that is mounted on the top end of the of the pile.

25. A vessel provided with the pile driving system according to claim 1.

26. A pile driving method for driving a hollow tubular pile having a vertical centreline, a top end and an open foot end vertically into the soil wherein use is made of a pile driving system, wherein the method comprises the steps of:

setting up the pile with the open foot in the sea floor, while supporting the pile above water in a radial direction using a pile guide mounted on a vessel;

generating an axial pile driving force along a pile drive axis, using at least one hammer device, wherein the pile drive axis is to be aligned with the vertical centreline of the pile, to drive the pile into the seafloor;

generating a torsional force about the pile drive axis, using the torsional vibration drive, to rotate the pile about the vertical centreline to reduce friction between the pile and the seafloor; and allowing free movement of the torsional vibration drive along the pile drive axis to prevent the direct transfer of impact forces from the impact hammer to the torsional vibration drive, and limiting free movement of the torsional vibration drive about the pile drive axis to enable direct transfer of the torsional forces from the torsional vibration drive to the impact hammer or the pile.

27. The pile driving method according to claim 26, wherein the pile driving system according comprises:

at least one hammer device configured to transfer energy from the respective hammer device to the top of the pile at a respective frequency along a pile drive axis, wherein the pile drive axis is parallel to, the central longitudinal axis of the pile; and a torsional vibration drive, wherein the torsional vibration drive comprises at least one vibratory pile driver device, that engages on the pile or on the hammer device, and wherein each vibratory pile driver device of the torsional vibration drive is configured and operated simultaneously with the operation of the at least one hammer device to apply an alternating force at a respective vibration frequency about the pile drive axis.

* * * * *